US007515719B2

(12) United States Patent
Hooley et al.

(10) Patent No.: US 7,515,719 B2
(45) Date of Patent: Apr. 7, 2009

(54) METHOD AND APPARATUS TO CREATE A SOUND FIELD

(75) Inventors: Anthony Hooley, Cambridge (GB); Paul Thomas Troughton, Cambridge (GB); Angus Gavin Goudie, Cambridge (GB); Mark George Easton, Cambridge (GB); Irving Alexander Bienek, Cambridge (GB); James Davies, Cambridge (GB); Damon Thomas Ryan, Cambridge (GB); Paul Raymond Windle, Essex (GB)

(73) Assignee: Cambridge Mechatronics Limited, Cambridge (GB)

( * ) Notice: Subject to any disclaimer, the term of this patent is extended or adjusted under 35 U.S.C. 154(b) by 1124 days.

(21) Appl. No.: 10/471,451

(22) PCT Filed: Mar. 27, 2002

(86) PCT No.: PCT/GB02/01472

§ 371 (c)(1),
(2), (4) Date: Mar. 22, 2004

(87) PCT Pub. No.: WO02/078388

PCT Pub. Date: Oct. 3, 2002

(65) Prior Publication Data

US 2004/0151325 A1 Aug. 5, 2004

(30) Foreign Application Priority Data

Mar. 27, 2001 (GB) ..... 0107699.1
Jan. 8, 2002 (GB) ..... 0200291.3

(51) Int. Cl.
*H04R 5/00* (2006.01)
*H04R 5/02* (2006.01)

(52) U.S. Cl. ... 381/18; 381/335; 381/61 (58) Field of Classification Search ..... 381/1, 17–19, 61, 381/63, 332, 335, 307, 310
See application file for complete search history.

(56) References Cited

U.S. PATENT DOCUMENTS 3,992,586 A 11/1976 Jaffe (Continued)

FOREIGN PATENT DOCUMENTS

DE 966384 C 8/1957

(Continued)

OTHER PUBLICATIONS

Setsu Komiyama; "Distance Control of Sound Images for 3D TV"; Aug. 1992, pp. 1-11: Nos. 406, NHK Laboratories Note, Tokyo, Japan.

(Continued)

*Primary Examiner*—Xu Mei
(74) *Attorney, Agent, or Firm*—Gerry J. Elman; Elman Technology Law, P.C.

(57) ABSTRACT

The invention generally relates to a method and apparatus for taking an input signal, replicating it a number of times and modifying each of the replicas before routing them to respective output transducers such that a desired sound field is created. This sound field may comprise a directed beam, focussed beam or a simulated origin. In a first aspect, delays are added to sound channels to remove the effects of different travelling distances. In a second aspect, a delay is added to a video signal to account for the delays added to the sound channels. In a third aspect, different window functions are applied to each channel to give improved flexibility of use. In a fourth aspect, a smaller extent of transducers is used top output high frequencies than are used to output low frequencies. An array having a larger density of transducers near the centre is also provided. In a fifth aspect, a line of elongate transducers is provided to give good directivity in a plane. In a sixth aspect, sound beams are focussed in front or behind surfaces to give different beam widths and simulated origins. In a seventh aspect, a camera is used to indicate where sound is directed.

26 Claims, 18 Drawing Sheets

U.S. PATENT DOCUMENTS

| | | | | |
|---|---|---|---|---|
| 3,996,561 | A | 12/1976 | Kowal et al. | |
| 4,042,778 | A | 8/1977 | Clinton et al. | |
| 4,190,739 | A | 2/1980 | Torffield | |
| 4,256,922 | A | 3/1981 | Gorike | |
| 4,283,600 | A * | 8/1981 | Cohen | 381/61 |
| 4,305,296 | A | 12/1981 | Green et al. | |
| 4,330,691 | A | 5/1982 | Gordon | |
| 4,332,018 | A | 5/1982 | Sternberg et al. | |
| 4,388,493 | A | 6/1983 | Maisel | |
| 4,399,328 | A | 8/1983 | Franssen, deceased et al. | |
| 4,472,834 | A | 9/1984 | Yamamuro et al. | |
| 4,515,997 | A | 5/1985 | Stinger, Jr. | |
| 4,518,889 | A | 5/1985 | 'T Hoen | |
| 4,653,505 | A | 3/1987 | Iinuma | |
| 4,769,848 | A | 9/1988 | Eberbach | |
| 4,773,096 | A | 9/1988 | Kirn | |
| 4,972,381 | A | 11/1990 | Mitchell et al. | |
| 4,980,871 | A | 12/1990 | Sieber et al. | |
| 4,984,273 | A | 1/1991 | Aylward et al. | |
| 5,051,799 | A | 9/1991 | Paul et al. | |
| 5,131,051 | A | 7/1992 | Kishinaga et al. | |
| 5,166,905 | A | 11/1992 | Currie | |
| 5,227,591 | A | 7/1993 | Tarkkonen | |
| 5,233,664 | A | 8/1993 | Yanagawa et al. | |
| 5,287,531 | A | 2/1994 | Rogers, Jr. et al. | |
| 5,313,172 | A | 5/1994 | Vagher | |
| 5,313,300 | A | 5/1994 | Rabile | |
| 5,438,624 | A | 8/1995 | Lewiner et al. | |
| 5,488,956 | A | 2/1996 | Bartlelt et al. | |
| 5,491,754 | A * | 2/1996 | Jot et al. | 381/63 |
| 5,517,200 | A | 5/1996 | McAdam et al. | |
| 5,555,306 | A * | 9/1996 | Gerzon | 381/63 |
| 5,581,618 | A | 12/1996 | Satoshi et al. | |
| 5,742,690 | A | 4/1998 | Edgar | |
| 5,745,435 | A | 4/1998 | Fage et al. | |
| 5,751,821 | A | 5/1998 | Smith | |
| 5,763,785 | A | 6/1998 | Chiang | |
| 5,802,190 | A | 9/1998 | Ferren | |
| 5,809,150 | A | 9/1998 | Eberbach | |
| 5,822,438 | A | 10/1998 | Sekine et al. | |
| 5,832,097 | A | 11/1998 | Armstrong et al. | |
| 5,834,647 | A | 11/1998 | Gaudriot et al. | |
| 5,841,394 | A | 11/1998 | Sterns et al. | |
| 5,859,915 | A | 1/1999 | Norris | |
| 5,867,123 | A | 2/1999 | Geyh et al. | |
| 5,870,484 | A | 2/1999 | Greenberger | |
| 5,885,129 | A | 3/1999 | Norris | |
| 5,953,432 | A | 9/1999 | Yanagawa et al. | |
| 5,963,432 | A | 10/1999 | Crowley | |
| 6,002,776 | A * | 12/1999 | Bhadkamkar et al. | 381/66 |
| 6,005,642 | A | 12/1999 | Meisner et al. | |
| 6,084,974 | A | 7/2000 | Niimi | |
| 6,122,223 | A | 9/2000 | Hossack | |
| 6,128,395 | A | 10/2000 | De Vries et al. | |
| 6,154,553 | A | 11/2000 | Taylor | |
| 6,169,806 | B1 | 1/2001 | Kimura et al. | |
| 6,243,476 | B1 | 6/2001 | Gardner | |
| 6,294,905 | B1 | 9/2001 | Schwartz | |
| 6,373,955 | B1 * | 4/2002 | Hooley | 381/335 |
| 6,807,281 | B1 | 10/2004 | Sasaki et al. | |
| 6,856,688 | B2 * | 2/2005 | Cromer et al. | 381/303 |
| 6,967,541 | B2 | 11/2005 | Hooley | |
| 7,092,541 | B1 | 8/2006 | Eberbach | |
| 2001/0007591 | A1 | 7/2001 | Pompei | |
| 2001/0038702 | A1 | 11/2001 | Lavoie et al. | |
| 2001/0043652 | A1 | 11/2001 | Hooley | |
| 2002/0126854 | A1 | 9/2002 | Norris et al. | |
| 2002/0131608 | A1 | 9/2002 | Lobb et al. | |
| 2002/0159336 | A1 | 10/2002 | Brown et al. | |
| 2003/0091203 | A1 | 5/2003 | Croft, III et al. | |
| 2004/0151325 | A1 | 8/2004 | Hooley et al. | |
| 2004/0264707 | A1 | 12/2004 | Yang et al. | |
| 2005/0041530 | A1 | 2/2005 | Goudie et al. | |
| 2005/0089182 | A1 | 4/2005 | Troughton et al. | |
| 2005/0207590 | A1 | 9/2005 | Niehoff et al. | |
| 2005/0265558 | A1 * | 12/2005 | Neoran | 381/17 |
| 2006/0204022 | A1 | 9/2006 | Hooley et al. | |
| 2007/0154019 | A1 * | 7/2007 | Kim | 381/17 |

FOREIGN PATENT DOCUMENTS

| | | | |
|---|---|---|---|
| DE | 31 42 462 | A1 | 5/1982 |
| DE | 40 33 068 | A1 | 4/1991 |
| DE | 44 28 500 | A1 | 3/1995 |
| DE | 43 43 807 | A1 | 6/1995 |
| EP | 0 025 118 | A1 | 3/1981 |
| EP | 0 323 110 | A2 | 7/1989 |
| EP | 0 351 055 | A1 | 1/1990 |
| EP | 0 492 015 | A1 | 7/1992 |
| EP | 0521655 | A1 | 1/1993 |
| EP | 0 591 899 | A1 | 4/1994 |
| EP | 0 642 032 | A2 | 3/1995 |
| EP | 00807990 | A1 | 11/1997 |
| EP | 1 026 663 | A2 | 8/2000 |
| EP | 1 061 769 | A2 | 12/2000 |
| EP | 1 122 973 | A2 | 8/2001 |
| EP | 1199907 | A | 4/2002 |
| EP | 1348954 | A1 | 10/2003 |
| ES | 2 116 929 | | 7/1978 |
| FR | 2 628 335 | | 9/1989 |
| GB | 1 571 714 | | 7/1980 |
| GB | 1 603 201 | | 11/1981 |
| GB | 2077552 | A | 12/1981 |
| GB | 2094101 | A | 9/1982 |
| GB | 2 209 229 | A | 5/1989 |
| GB | 2 243 040 | A | 10/1991 |
| GB | 2 259 364 | A | 3/1993 |
| GB | 2259426 | A | 3/1993 |
| GB | 2273848 | A | 6/1994 |
| GB | 2 277 152 | A | 10/1994 |
| GB | 2 290 380 | A | 12/1995 |
| GB | 2239763 | A | 1/1997 |
| GB | 2303019 | A | 2/1997 |
| GB | 2 320 351 | B | 6/1998 |
| GB | 2 326 559 | A | 12/1998 |
| GB | 2 332 052 | A | 6/1999 |
| GB | 2333842 | A | 8/1999 |
| GB | 2 340 351 | A | 2/2000 |
| GB | 2 345 967 | A | 7/2000 |
| GB | 2 358 117 | A | 7/2001 |
| JP | 57-068991 | | 4/1982 |
| JP | 59-189498 | | 10/1984 |
| JP | 59-179743 | | 3/1986 |
| JP | 61-057198 | | 3/1986 |
| JP | 61-253996 | | 11/1986 |
| JP | 62-076958 | | 4/1987 |
| JP | 61-152498 | | 1/1988 |
| JP | 63-009300 | | 1/1988 |
| JP | 63-014588 | | 1/1988 |
| JP | 62-068410 | | 9/1988 |
| JP | 63-234699 | | 9/1988 |
| JP | 62-103315 | | 11/1988 |
| JP | 63-269699 | | 11/1988 |
| JP | 62-133476 | | 12/1988 |
| JP | 63-300699 | | 12/1988 |
| JP | 64061601 | | 3/1989 |
| JP | 02142285 | | 5/1990 |
| JP | 02-013097 | | 7/1990 |
| JP | 01-061601 | | 9/1990 |
| JP | 02-239798 | | 9/1990 |
| JP | 02257798 | | 10/1990 |
| JP | 01-297716 | | 7/1991 |
| JP | 01-298457 | | 7/1991 |
| JP | 03-159400 | | 7/1991 |

| | | | |
|---|---|---|---|
| JP | 03-159500 | | 7/1991 |
| JP | 03169200 | | 7/1991 |
| JP | 04-127700 | | 4/1992 |
| JP | 04132499 | | 5/1992 |
| JP | 03-004842 | | 11/1992 |
| JP | 04-313996 | | 11/1992 |
| JP | 03-197864 | | 2/1993 |
| JP | 05-041897 | | 2/1993 |
| JP | 03-252315 | | 4/1993 |
| JP | 05-091596 | | 4/1993 |
| JP | 05191898 | | 7/1993 |
| JP | 04-008975 | | 8/1993 |
| JP | 05-199583 | | 8/1993 |
| JP | 05-199598 | | 8/1993 |
| JP | 05-199598 | A | 8/1993 |
| JP | 04-153224 | | 12/1993 |
| JP | 05-344584 | | 12/1993 |
| JP | 06-038289 | | 2/1994 |
| JP | 04-214144 | | 3/1994 |
| JP | 06-062488 | | 3/1994 |
| JP | 06-178379 | | 6/1994 |
| JP | 05-001321 | | 7/1994 |
| JP | 06-205496 | | 7/1994 |
| JP | 05-010123 | | 8/1994 |
| JP | 06-225379 | | 8/1994 |
| JP | 06-318087 | | 11/1994 |
| JP | 06-334459 | | 12/1994 |
| JP | 07-007788 | | 1/1995 |
| JP | 05-301465 | | 6/1995 |
| JP | 07-154893 | | 6/1995 |
| JP | 07-193896 | | 7/1995 |
| JP | 05-349872 | | 8/1995 |
| JP | 07-203581 | | 8/1995 |
| JP | 08-051690 | | 2/1996 |
| JP | 08181962 | | 7/1996 |
| JP | 10-285683 | | 10/1998 |
| JP | 11-027604 | | 1/1999 |
| JP | 09-200439 | | 2/1999 |
| JP | 11-030525 | | 2/1999 |
| JP | 11-046400 | | 2/1999 |
| JP | 2000023300 | | 1/2000 |
| JP | 2000217197 | | 8/2000 |
| JP | 11-101805 | | 10/2000 |
| JP | 11-102110 | | 10/2000 |
| JP | 2000-295686 | | 10/2000 |
| JP | 2000-295697 | | 10/2000 |
| JP | 11-242970 | | 3/2001 |
| JP | 2001-069591 | | 3/2001 |
| JP | 2001078290 | | 3/2001 |
| JP | 11-269583 | | 4/2001 |
| JP | 2001-095082 | | 4/2001 |
| SU | 1678327 | | 9/1991 |
| WO | 95/20214 | A1 | 7/1995 |
| WO | WO 96/14723 | | 5/1996 |
| WO | WO 96/31086 | | 10/1996 |
| WO | WO 97/32449 | | 9/1997 |
| WO | WO 98/58522 | | 12/1998 |
| WO | WO 99/00780 | | 1/1999 |
| WO | WO 99/35881 | | 7/1999 |
| WO | 99/41943 | A1 | 8/1999 |
| WO | 0108449 | A1 | 2/2001 |
| WO | WO 01/23104 | A2 | 4/2001 |
| WO | 0152437 | A1 | 7/2001 |
| WO | 0241664 | A2 | 5/2002 |
| WO | 02078388 | A2 | 10/2002 |
| WO | 03019125 | A1 | 3/2003 |
| WO | 03026343 | A2 | 3/2003 |
| WO | 03034780 | A2 | 4/2003 |
| WO | 03059005 | A2 | 7/2003 |
| WO | 03071827 | A2 | 8/2003 |
| WO | 2004066673 | A1 | 8/2004 |
| WO | 2004075601 | A1 | 9/2004 |
| WO | 2005027514 | A1 | 3/2005 |
| WO | 2005086526 | A1 | 9/2005 |
| WO | 2006005938 | A1 | 1/2006 |
| WO | 2006005948 | A1 | 1/2006 |
| WO | 2006016156 | A1 | 2/2006 |
| WO | 2006030198 | A1 | 3/2006 |
| WO | 2007007083 | A1 | 1/2007 |

OTHER PUBLICATIONS

"Waveform Inversion for Individual Ambient Sount Control" IBM Technical Disclosure Bulletin, IBM Corp, New York, vol. 36 No. 9A pp. 537-540 (Sep. 1, 1993 US).

Troughton "Convenient Multi-Channel Sound in the Home" 17th Audio Engineering Society UK Conference, 2002, pp. 102-105 & cover sheet (AES Ltd. Slough UK).

Johan Van Der Werff, "Design and implementation of a sound column with exceptional properties", preprint of 96th AES Convention, Amsterdam, No. 3835, XP007901141, Feb. 26, 1994.

* cited by examiner

METHOD AND APPARATUS TO CREATE A SOUND FIELD

FIELD OF THE INVENTION

This invention relates to steerable acoustic antennae, and concerns in particular digital electronically-steerable acoustic antennae.

BACKGROUND TO THE INVENTION

Phased array antennae are well known in the art in both the electromagnetic and the ultrasonic acoustic fields. They are less well known, but exist in simple forms, in the sonic (audible) acoustic area. These latter are relatively crude, and the invention seeks to provide improvements related to a superior audio acoustic array capable of being steered so as to direct its output more or less at will.

WO 96/31086 describes a system which uses a unary coded signal to drive a an array of output transducers. Each transducer is capable of creating a sound pressure pulse and is not able to reproduce the whole of the signal to be output.

SUMMARY OF THE INVENTION

A first aspect of the present invention addresses the problem that can arise when multiple channels are output by a single array of output transducers with each channel being directed in a different direction. Due to the fact that each channel takes a different path to the listener, the channels can be audibly out of synchronism when they arrive at the listener's position.

In accordance with the first aspect, there is provided a method of creating a sound field comprising a plurality of channels of sound using an array of output transducers, said method comprising:

for each channel, selecting a first delay value in respect of each output transducer, said first delay value being chosen in accordance with the position in the array of the respective transducer;

selecting a second delay value for each channel, said second delay value being chosen in accordance with the expected travelling distance of sound waves of that channel from said array to a listener;

obtaining, in respect of each output transducer, a delayed replica of a signal representing each channel, each delayed replica being delayed by a value having a first component comprising said first delay value and a second component comprising said second delay value.

Also in accordance with the first aspect of the invention there is provided apparatus for creating a sound field comprising:

a plurality of inputs for a plurality of respective signals representing different sound channels;

an array of output transducers;

replication means arranged to obtain, in respect of each output transducer, a replica of each respective input signal;

first delay means arranged to delay each replica of each signal by a respective first delay value chosen in accordance with the position in the array of the respective output transducer;

second delay means arranged to delay each replica of each signal by a second delay value chosen for each channel in accordance with the expected travelling distance of sound waves of that channel from the array to a listener.

Thus, there is provided a method and apparatus for applying two types of delay to each sound channel to alleviate the effect of different travelling distances for each channel.

A second aspect of the invention addresses the problem that arises in audio-visual applications of the array of output transducers. Due to the various delays that often need to be applied to the channels to create the desired effects, the sound channels can lag behind the video pictures noticeably.

According to the second aspect of the invention, there is provided a method of providing temporal correspondence between pictures and sound in an audio-visual presentation using an array of output transducers to reproduce the sound content comprising a plurality of channels, said method comprising:

delaying, in respect of each output transducer, a replica of each signal representing a sound channel by a respective audio delay value;

delaying a video signal by a video delay value calculated so corresponding video pictures are displayed at substantially the time the temporally corresponding sound channels reach the listener.

Further, in accordance with the second aspect of the present invention, there is provided apparatus to provide temporal correspondence between pictures and a plurality of sound channels in an audio-visual presentation comprising:

an array of output transducers;

replication and delay means arranged to obtain, in respect of each output transducer, a delayed replica of each signal representing a sound channel;

video delay means arranged to delay a corresponding video signal by a video delay value calculated so corresponding video pictures are displayed at substantially the time the temporally corresponding sound channels reach the listener.

This aspect of the invention thus allows the video and sound channels to arrive at the viewer/listener at the correct time (ie in temporal correspondence with one another)

A third aspect of the present invention addresses the problem that different sound channels may have different contents and thus there are different needs in terms of the directivity to be achieved by any particular beam representing a sound channel.

Accordingly, the third aspect of the invention provides a method of creating a sound field comprising a plurality of channels of sound using an array of output transducers, said method comprising:

for each channel, obtaining, in respect of each output transducer, a replica of a signal representing said channel so as to obtain a set of replica signals for each channel;

applying a first window function to a first set of replica signals originating from a first sound channel signal;

applying a second, different, window function to a second set of replica signals originating from a second sound channel signal.

Further, in accordance with the third aspect of the invention, there is provided apparatus to create a sound field comprising a plurality of channels of sound, comprising:

an array of output transducers;

replication means for providing, in respect of each output transducer, a replica of a signal representing each of said plurality of channels;

windowing means for applying a first window function to a first set of replica signals originating from a first sound channel signal and for applying a second, different, window function to a second set of replica signals originating from a second channel signal.

This aspect therefore allows different window functions to be applied to different sound channels giving a more desirable sound field and making it easier to adjust the volume of each sound channel independently.

A fourth aspect of the invention addresses the problem that a large array is required to direct low frequencies whereas a smaller array can direct high frequencies to the same accuracy. Further, low frequencies require higher power than high frequencies.

In accordance with the fourth aspect of the invention there is provided a method of creating a sound field using an array of output transducers, said method comprising:

dividing an input signal into at least a low frequency component and a high frequency component;

using output transducers spanning a first portion of the array to output said low frequency component; and using output transducers spanning a second portion of said array smaller than said first portion to output said high frequency component.

Further in accordance with the fourth aspect of the invention there is provided apparatus for creating a sound field comprising:

an array of output transducers wherein in a first area of the array the output transducers are more densely packed than in the remainder of said array.

This aspect therefore allows all the frequencies to be output with the desired directivity using an efficient number of output transducers.

A fifth aspect of the invention relates to an efficient configuration of array which can direct sound substantially within a desired plane.

In accordance with the fifth aspect of the invention there is provided an array of output transducers positioned next to each other in a line; wherein each of said output transducers has a dimension in the direction perpendicular to said line larger than the dimension parallel to said line.

The above described configuration is particularly useful since the sound is primarily concentrated in a plane extending horizontally out of the front of the array. The concentration to a plane is achieved due to the elongate nature of the individual transducers and the directivity is achieved due to the plurality of transducers in the array.

The sixth aspect of the invention addresses the need to direct narrow or broad beams to a defined position using reflective or resonant surfaces in accordance with a users desire.

In accordance with the sixth aspect of the present invention there is provided A method of causing plural input signals representing respective channels to appear to emanate from respective different positions in space, said method comprising:

providing a sound reflective or resonant surface at each of said positions in space;

providing an array of output transducers distal from said positions in space; and directing, using said array of output transducers, sound waves of each channel towards the respective position in space to cause said sound waves to be re-transmitted by said reflective or resonant surface, said sound waves being focussed at a position in space in front of, or behind, said reflective or resonant surface;

said step of directing comprising:

obtaining, in respect of each transducer, a delayed replica of each input signal delayed by a respective delay selected in accordance with the position in the array of the respective output transducer and said respective focus position such that the sound waves of the channel are directed towards the focus position in respect of that channel;

summing, in respect of each transducer, the respective delayed replicas of each input signal to produce an output signal; and routing the output signals to the respective transducers.

Further in accordance with the sixth aspect of the present invention there is provided an apparatus for causing plural input signals representing respective channels to appear to emanate from respective different positions in space, said apparatus comprising:

a sound reflective or resonant surface at each of said positions in space;

an array of output transducers distal from said positions in space; and a controller for directing, using said array of output transducers, sound waves of each channel towards that channel's respective position in space such that said sound waves are re-transmitted by said reflective or resonant surface, said sound waves being focussed at a position in space in front of, or behind, said reflective or resonant surface;

said controller comprising:

replication and delay means arranged to obtain, in respect of each transducer, a delayed replica of the input signal delayed by a respective delay selected in accordance with the position in the array of the respective output transducer and the respective focus position such that the sound waves of the channel are directed towards the focus position in respect of that input signal;

adder means arranged to sum, in respect of each transducer, the respective delayed replicas of each input signal to produce an output signal; and means to route the output signals to the respective transducers such that the channel sound waves are directed towards the focus position in respect of that input signal.

The sixth aspect of the invention allows a narrow or broad beam to be re-transmitted in accordance with the focus position being chosen behind or in front of the reflector/resonator.

The seventh aspect of the invention addresses the problem that it can be difficult to determine exactly where sound is directed or focussed and there is a requirement for an intuitive method which allows an operator to control (with feedback) where the sound is directed or focussed.

In accordance with the seventh aspect of the present invention there is provided a method of selecting a direction in which to focus sound, said method comprising;

pointing a video camera in the desired direction, using the viewfinder or other screen means to determine if the direction is that desired;

calculating a plurality of signal delays to be applied to a set of replicas of an input signal so as to direct sound in the selected direction.

Further in accordance with the seventh aspect of the present invention there is provided a method of determining where sound is directed, said method comprising:

automatically adjusting the direction in which a video camera points in accordance with the direction in which sound is directed;

discerning from the viewfinder or other screen means which direction the camera is pointing in.

Furthermore in accordance with the seventh aspect of the present invention there is provided an apparatus for setting up or monitoring a sound field comprising:

an array of output transducers;

a directable video camera;

means controlling said array of output transducers and said video camera such that said video camera points in the same direction as a sound beam from said array is directed.

The seventh aspect of the invention thus allows a user to determine where sound is directed in an intuitive and easy manner.

Generally, the invention is applicable to a preferably fully digital steerable acoustic phased array antenna (a Digital Phased-Array Antennae, or DPAA) system comprising a plurality of spatially-distributed sonic electroacoustic transducers (SETs) arranged in a two-dimensional array and each connected to the same digital signal input via an input signal Distributor which modifies the input signal prior to feeding it to each SET in order to achieve the desired directional effect.

The various possibilities inherent in this, and the versions that are actually preferred, will be seen from the following:—

The SETs are preferably arranged in a plane or curved surface (a Surface), rather than randomly in space. They may also, however, be in the form of a 2-dimensional stack of two or more adjacent sub-arrays—two or more closely-spaced parallel plane or curved surfaces located one behind the next.

Within a Surface the SETs making up the array are preferably closely spaced, and ideally completely fill the overall antenna aperture. This is impractical with real circular-section SETs but may be achieved with triangular, square or hexagonal section SETs, or in general with any section which tiles the plane. Where the SET sections do not tile the plane, a close approximation to a filled aperture may be achieved by making the array in the form of a stack or arrays—ie, three-dimensional—where at least one additional Surface of SETs is mounted behind at least one other such Surface, and the SETs in the or each rearward array radiate between the gaps in the frontward array(s).

The SETs are preferably similar, and ideally they are identical. They are, of course, sonic—that is, audio—devices, and most preferably they are able uniformly to cover the entire audio band from perhaps as low as (or lower than) 20 Hz, to as much as 20 KHz or more (the Audio Band). Alternatively, there can be used SETs of different sonic capabilities but together covering the entire range desired. Thus, multiple different SETs may be physically grouped together to form a composite SET (CSET) wherein the groups of different SETs together can cover the Audio Band even though the individual SETs cannot. As a further variant, SETs each capable of only partial Audio Band coverage can be not grouped but instead scattered throughout the array with enough variation amongst the SETs that the array as a whole has complete or more nearly complete coverage of the Audio Band.

An alternative form of CSET contains several (typically two) identical transducers, each driven by the same signal. This reduces the complexity of the required signal processing and drive electronics while retaining many of the advantages of a large DPAA. Where the position of a CSET is referred to hereinafter, it is to be understood that this position is the centroid of the CSET as a whole, i.e. the centre of gravity of all of the individual SETs making up the CSET.

Within a Surface the spacing of the SETs or CSET (hereinafter the two are denoted just by SETs)—that is, the general layout and structure of the array and the way the individual transducers are disposed therein—is preferably regular, and their distribution about the Surface is desirably symmetrical. Thus, the SETs are most preferably spaced in a triangular, square or hexagonal lattice. The type and orientation of the lattice can be chosen to control the spacing and direction of side-lobes.

Though not essential, each SET preferably has an omnidirectional input/output characteristic in at least a hemisphere at all sound wavelengths which it is capable of effectively radiating (or receiving).

Each output SET may take any convenient or desired form of sound radiating device (for example, a conventional loudspeaker), and though they are all preferably the same they could be different. The loudspeakers may be of the type known as pistonic acoustic radiators (wherein the transducer diaphragm is moved by a piston) and in such a case the maximum radial extent of the piston-radiators (eg, the effective piston diameter for circular SETs) of the individual SETs is preferably as small as possible, and ideally is as small as or smaller than the acoustic wavelength of the highest frequency in the Audio Band (eg in air, 20 KHz sound waves have a wavelength of approximately 17 mm, so for circular pistonic transducers, a maximum diameter of about 17 mm is preferable, with a smaller size being preferred to ensure omnidirectionality).

The overall dimensions of the or each array of SETs in the plane of the array are very preferably chosen to be as great as or greater than the acoustic wavelength in air of the lowest frequency at which it is intended to significantly affect the polar radiation pattern of the array. Thus, if it is desired to be able to beam or steer frequencies as low as 300 Hz, then the array size, in the direction at right angles to each plane in which steering or beaming is required, should be at least $c_s/300 \cong 1.1$ meter (where $c_s$ is the acoustic sound speed).

The invention is applicable to fully digital steerable sonic/audible acoustic phased array antenna system, and while the actual transducers can be driven by an analogue signal most preferably they are driven by a digital power amplifier. A typical such digital power amplifier incorporates: a PCM signal input; a clock input (or a means of deriving a clock from the input PCM signal); an output clock, which is either internally generated, or derived from the input clock or from an additional output clock input; and an optional output level input, which may be either a digital (PCM) signal or an analogue signal (in the latter case, this analogue signal may also provide the power for the amplifier output). A characteristic of a digital power amplifier is that, before any optional analogue output filtering, its output is discrete valued and stepwise continuous, and can only change level at intervals which match the output clock period. The discrete output values are controlled by the optional output level input, where provided. For PWM-based digital amplifiers, the output signal's average value over any integer multiple of the input sample period is representative of the input signal. For other digital amplifiers, the output signal's average value tends towards the input signal's average value over periods greater than the input sample period. Preferred forms of digital power amplifier include bipolar pulse width modulators, and one-bit binary modulators.

The use of a digital power amplifier avoids the more common requirement—found in most so-called "digital" systems—to provide a digital-to-analogue converter (DAC) and a linear power amplifier for each transducer drive channel, and therefore the power drive efficiency can be very high. Moreover, as most moving coil acoustic transducers are inherently inductive, and mechanically act quite effectively as low pass filters, it may be unnecessary to add elaborate electronic low-pass filtering between the digital drive circuitry and the SETs. In other words, the SETs can be directly driven with digital signals.

The DPAA has one or more digital input terminals (Inputs). When more than one input terminal is present, it is necessary to provide means for routing each input signal to the individual SETs.

This may be done by connecting each of the inputs to each of the SETs via one or more input signal Distributors. At the most basic, an input signal is fed to a single Distributor, and that single Distributor has a separate output to each of the SETs (and the signal it outputs is suitably modified, as discussed hereinafter, to achieve the end desired). Alternatively, there may be a number of similar Distributors, each taking the, or part of the, input signal, or separate input signals, and then each providing a separate output to each of the SETs (and in each case the signal it outputs is suitably modified, with the Distributor, as discussed hereinafter, to achieve the end desired). In this latter case—a plurality of Distributors each feeding all the SETs—the outputs from each Distributor to any one SET have to be combined, and conveniently this is done by an adder circuit prior to any further modification the resultant feed may undergo.

The Input terminals preferably receive one or more digital signals representative of the sound or sounds to be handled by the DPAA (Input Signals). Of course, the original electrical signal defining the sound to be radiated may be in an analogue form, and therefore the system of the invention may include one or more analogue-to-digital converters (ADCs) connected each between an auxiliary analogue input terminal (Analogue Input) and one of the Inputs, thus allowing the conversion of these external analogue electrical signals to internal digital electrical signals, each with a specific (and appropriate) sample rate $Fs_i$. And thus, within the DPAA, beyond the Inputs, the signals handled are time-sampled quantized digital signals representative of the sound waveform or waveforms to be reproduced by the DPAA.

The DPAA of the invention incorporates a Distributor which modifies the input signal prior to feeding it to each SET in order to achieve the desired directional effect. A Distributor is a digital device, or piece of software, with one input and multiple outputs. One of the DPAA's Input Signals is fed into its input. It preferably has one output for each SET; alternatively, one output can be shared amongst a number of the SETs or the elements of a CSET. The Distributor sends generally differently modified versions of the input signal to each of its outputs. The modifications can be either fixed, or adjustable using a control system. The modifications carried out by the distributor can comprise applying a signal delay, applying amplitude control and/or adjustably digitally filtering. These modifications may be carried out by signal delay means (SDM), amplitude control means (ACM) and adjustable digital filters (ADFs) which are respectively located within the Distributor. It is to be noted that the ADFs can be arranged to apply delays to the signal by appropriate choice of filter coefficients. Further, this delay can be made frequency dependent such that different frequencies of the input signal are delayed by different amounts and the filter can produce the effect of the sum of any number of such delayed versions of the signal. The terms "delaying" or "delayed" used herein should be construed as incorporating the type of delays applied by ADFs as well as SDMs. The delays can be of any useful duration including zero, but in general, at least one replicated input signal is delayed by a non-zero value.

The signal delay means (SDM) are variable digital signal time-delay elements. Here, because these are not single-frequency, or narrow frequency-band, phase shifting elements but true time-delays, the DPAA will operate over a broad frequency band (eg the Audio Band). There may be means to adjust the delays between a given input terminal and each SET, and advantageously there is a separately adjustable delay means for each Input/SET combination.

The minimum delay possible for a given digital signal is preferably as small or smaller than $T_s$, that signal's sample period; the maximum delay possible for a given digital signal should preferably be chosen to be as large as or larger than $T_c$, the time taken for sound to cross the transducer array across its greatest lateral extent, $D_{max}$, where $T_c=D_{max}/c_s$ where $c_s$ is the speed of sound in air. Most preferably, the smallest incremental change in delay possible for a given digital signal should be no larger than $T_s$, that signal's sample period. Otherwise, interpolation of the signal is necessary.

The amplitude control means (ACM) is conveniently implemented as digital amplitude control means for the purposes of gross beam shape modification. It may comprise an amplifier or alternator so as to increase or decrease the magnitude of an output signal. Like the SDM, there is preferably an adjustable ACM for each Input/SET combination. The amplitude control means is preferably arranged to apply differing amplitude control to each signal output from the Distributor so as to counteract for the fact that the DPAA is of finite size by using a window function. This is conveniently achieved by normalising the magnitude of each output signal in accordance with a predefined curve such as a Gaussian curve or a raised cosine curve. Thus, in general, output signals destined for SETs near the centre of the array will not be significantly affected but those near to the perimeter of the array will be attenuated according to how near to the edge of the array they are.

Another way of modifying the signal uses digital filters (ADF) whose group delay and magnitude response vary in a specified way as a function of frequency (rather than just a simple time delay or level change)—simple delay elements may be used in implementing these filters to reduce the necessary computation. This approach allows control of the DPAA radiation pattern as a function of frequency which allows control of the radiation pattern of the DPAA to be adjusted separately in different frequency bands (which is useful because the size in wavelengths of the DPAA radiating area, and thus its directionality, is otherwise a strong function of frequency). For example, for a DPAA of say 2 m extent its low frequency cut-off (for directionality) is around the 150 Hz region, and as the human ear has difficulty in determining directionality of sounds at such a low frequency it may be more useful not to apply "beam-steering" delays and amplitude weighting at such low frequencies but instead to go for an optimized output level. Additionally, the use of filters may also allow some compensation for unevenness in the radiation pattern of each SET.

The SDM delays, ACM gains and ADF coefficients can be fixed, varied in response to User input, or under automatic control. Preferably, any changes required while a channel is in use are made in many small increments so that no discontinuity is heard. These increments can be chosen to define predetermined "roll-off" and "attack" rates which describe how quickly the parameters are able to change.

Where more than one Input is provided—ie there are I inputs numbered 1 to I and where there are N SETs, numbered 1 to N, it is preferable to provide a separate and separately-adjustable delay, amplitude control and/or filter means $D_{in}$, (where I=1 to I, n=1 to N, between each of the I inputs and each of the N SETs) for each combination. For each SET there are thus I delayed or filtered digital signals, one from each of the Inputs via the separate Distributor, to be combined before application to the SET. There are in general N separate SDMs, ACMs and/or ADFs in each Distributor, one for each SET. As noted above, this combination of digital signals is conveniently done by digital algebraic addition of the I separate delayed signals—ie the signal to each SET is a linear combination of separately modified signals from each of the I Inputs. The requirement to perform digital addition of signals originating from more than one Input means that the digital sampling rate converters (DSRCS) may need to be used, to synchronize these external signals, as it is generally not meaningful to perform digital addition on two or more digital signals with different clock rates and/or phases.

The DPAA system may be used with a remote-control handset (Handset) that communicates with the DPAA electronics (via wires, or radio or infra-red or some other wireless technology) over a distance (ideally from anywhere in the listening area of the DPAA), and provides manual control over all the major functions of the DPAA. Such a control system would be most useful to provide the following functions:

1) selection of which Input(s) are to be connected to which Distributor, which might also be termed a "Channel";
2) control of the focus position and/or beam shape of each Channel;
3) control of the individual volume-level settings for each Channel; and
4) an initial parameter set-up using the Handset having a built-in microphone (see later).

There may also be:

means to interconnect two or more such DPAAs in order to coordinate their radiation patterns, their focussing and their optimization procedures;

means to store and recall sets of delays (for the DDGs) and filter coefficients (for the ADFs);

BRIEF DESCRIPTION OF THE DRAWINGS

The invention will be further described, by way of non-limitative example only, with reference to the accompanying schematic drawings, in which:—

DETAILED DESCRIPTION OF THE EMBODIMENTS

The description and Figures provided hereinafter necessarily describe the invention using block diagrams, with each block representing a hardware component or a signal processing step. The invention could, in principle, be realised by building separate physical components to perform each step, and interconnecting them as shown. Several of the steps could be implemented using dedicated or programmable integrated circuits, possibly combining several steps in one circuit. It will be understood that in practice it is likely to be most convenient to perform several of the signal processing steps in software, using Digital Signal Processors (DSPs) or general purpose microprocessors. Sequences of steps could then be performed by separate processors or by separate software routines sharing a microprocessor, or be combined into a single routine to improve efficiency.

The Figures generally only show audio signal paths; clock and control connections are omitted for clarity unless necessary to convey the idea. Moreover, only small numbers of SETs, Channels, and their associated circuitry are shown, as diagrams become cluttered and hard to interpret if the realistically large numbers of elements are included.

Before the respective aspects of the present invention are described, it is useful to describe embodiments of the apparatus which are suitable for use in accordance with any of the respective aspects.

Figure 1:
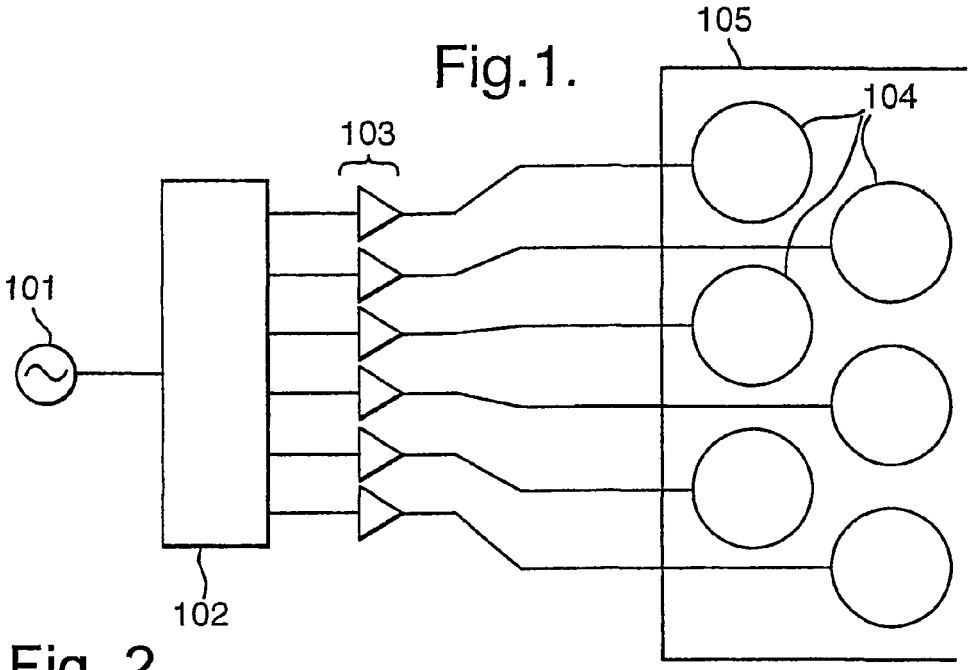
FIG. 1 shows a representation of a simple single-input apparatus.

The block diagram of FIG. 1 depicts a simple DPAA. An input signal (101) feeds a Distributor (102) whose many (6 in the drawing) outputs each connect through optional amplifiers (103) to output SETs (104) which are physically arranged to form a two-dimensional array (105). The Distributor modifies the signal sent to each SET to produce the desired radiation pattern. There may be additional processing steps before and after the Distributor, as illustrated later.

Figure 2:
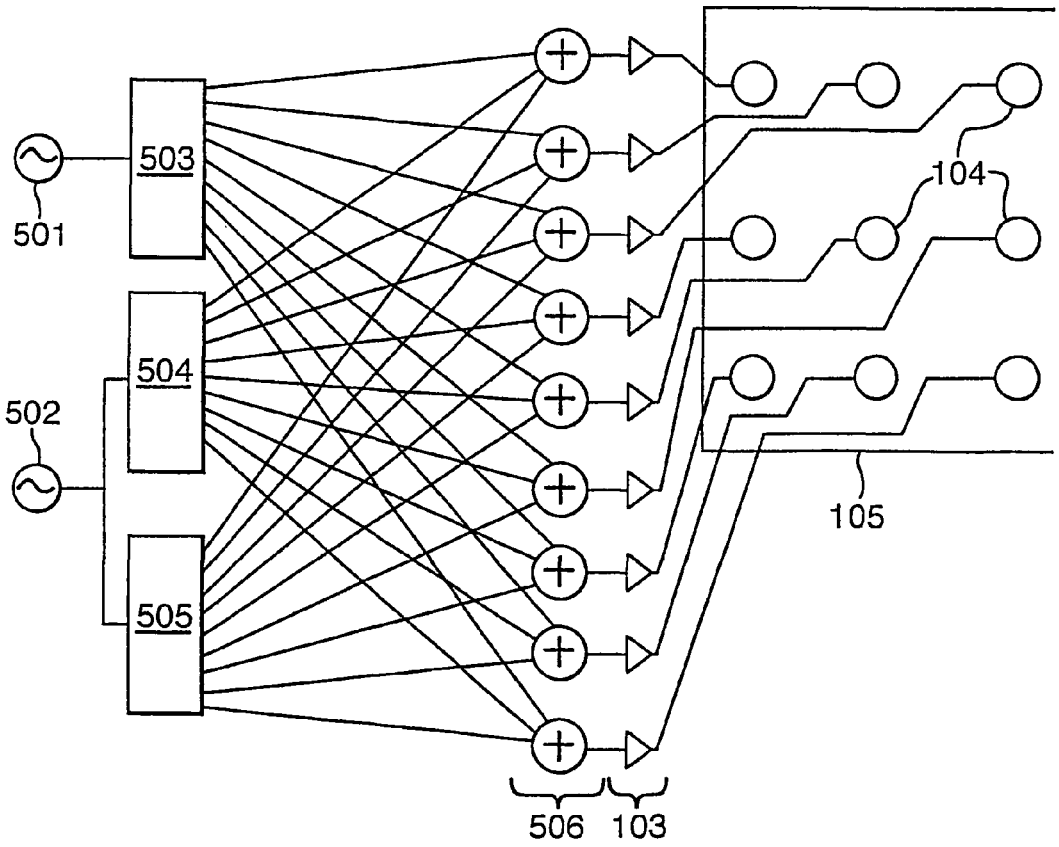
FIG. 2 is a block diagram of a multiple-input apparatus.

FIG. 2 shows a DPAA with two input signals (501,502) and three Distributors (503-505). Distributor 503 treats the signal 501, whereas both 504 and 505 treat the input signal 502. The outputs from each Distributor for each SET are summed by adders (506), and pass through amplifiers 103 to the SETs 104.

Figure 3:
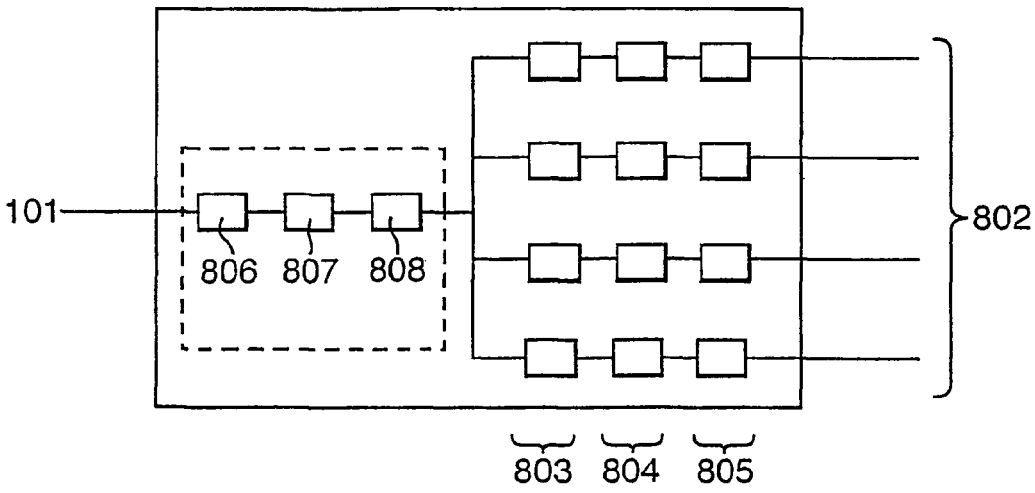
FIG. 3 is a block diagram of a general purpose Distributor.

FIG. 3 shows the components of a Distributor. It has a single input signal (101) coming from the input circuitry and multiple outputs (802), one for each SET or group of SETs. The path from the input to each of the outputs contains a SDM (803) and/or an ADF (804) and/or an ACM (805). If the modifications made in each signal path are similar, the Distributor can be implemented more efficiently by including global SDM, ADF and/or ACM stages (806-808) before splitting the signal. The parameters of each of the parts of each Distributor can be varied under User or automatic control. The control connections required for this are not shown.

Figure 4:
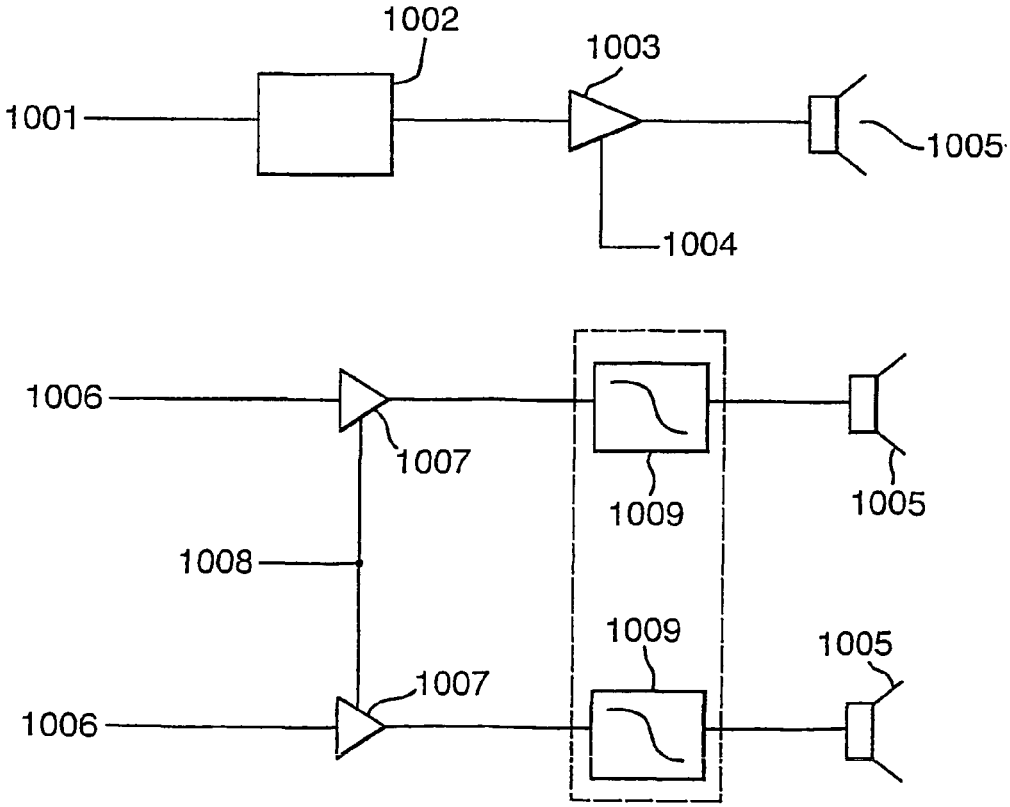
FIG. 4 is a block diagram of a linear amplifier and a digital amplifier used in preferred embodiments of the present invention.

FIG. 4 shows possible power amplifier configurations. In one option, the input digital signal (1001), possibly from a Distributor or adder, passes through a DAC (1002) and a linear power amplifier (1003) with an optional gain/volume control input (1004). The output feeds a SET or group of SETs (1005). In a preferred configuration, this time illustrated for two SET feeds, the inputs (1006) directly feed digital amplifiers (1007) with optional global volume control input (1008). The global volume control inputs can conveniently also serve as the power supply to the output drive circuitry. The discrete-valued digital amplifier outputs optionally pass through analogue low-pass filters (1009) before reaching the SETs (1005).

Figure 5:
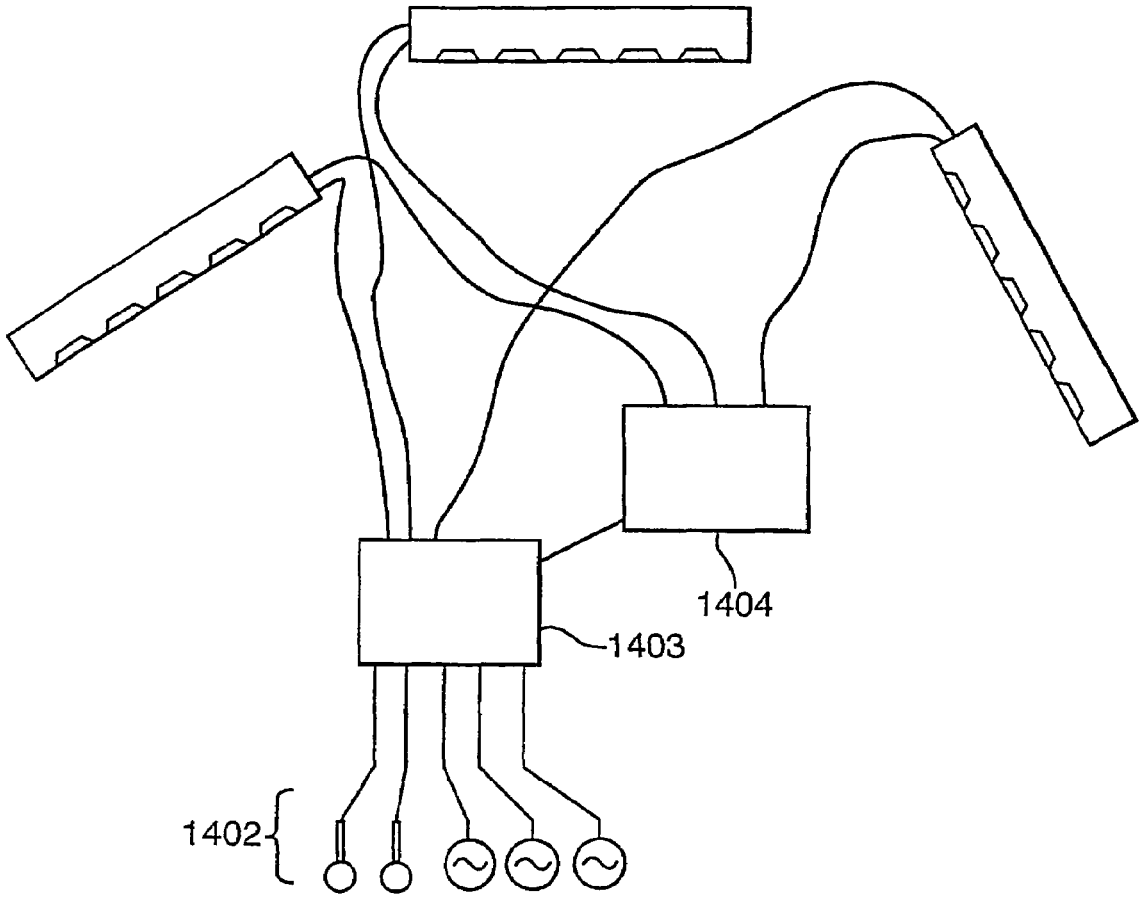
FIG. 5 shows the interconnection of several arrays with common control and input stages.

FIG. 5 illustrates the interconnection of three DPAAs (1401). In this case, the inputs (1402), input circuitry (1403) and control systems (1404) are shared by all three DPAAs. The input circuitry and control system could either be separately housed or incorporated into one of the DPAAs, with the others acting as slaves. Alternatively, the three DPAAs could be identical, with the redundant circuitry in the slave DPAAs merely inactive. This set-up allows increased power, and if the arrays are placed side by side, better directivity at low frequencies.

Figure 6:
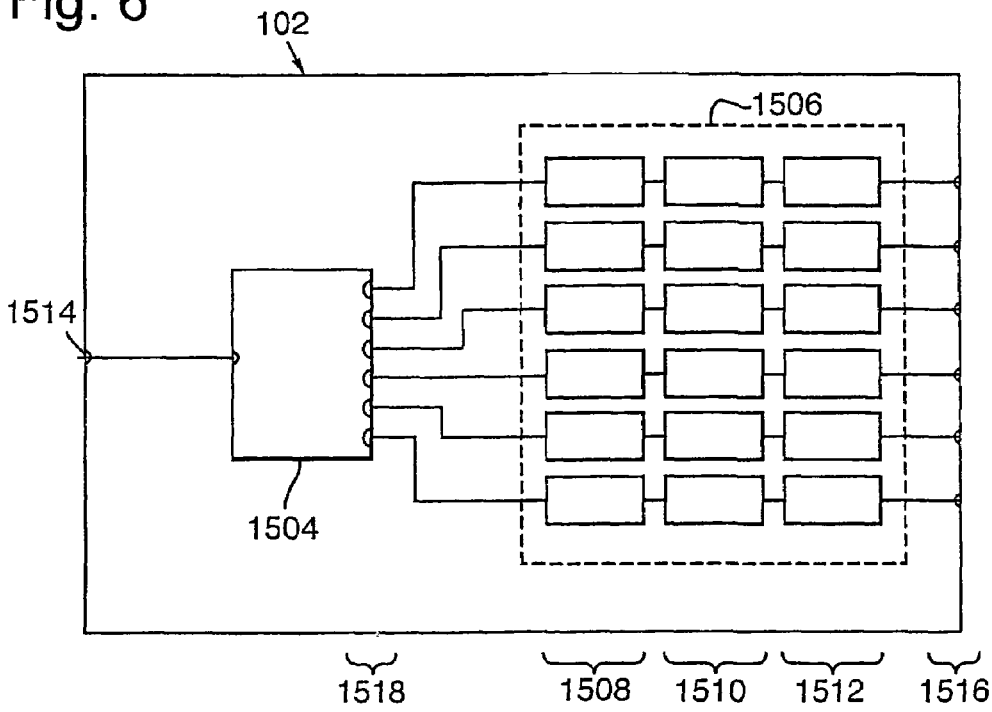
FIG. 6 shows a Distributor in accordance with the first aspect of the present invention.

The apparatus of FIGS. 6 and 7A to 7D has the general structure shown in FIG. 1. FIG. 6 shows a preferable Distributor (102) in further detail.

As can be seen from FIG. 6, the input signal (101) is routed to a replicator (1504) by means of an input terminal (1514). The replicator (1504) has the function of copying the input signal a pre-determined number of times and providing the same signal at said pre-determined number of output terminals (1518). Each replica of the input signal is then supplied to the means (1506) for modifying the replicas. In general, the means (1506) for modifying the replicas includes signal delay means (1508), amplitude control means (1510) and adjustable digital filter means (1512). However, it should be noted that the amplitude control means (1510) is purely optional. Further, one or other of the signal delay means (1508) and adjustable digital filter (1512) may also be dispensed with. The most fundamental function of the means (1506) to modify replicas is to provide that different replicas are in some sense delayed by generally different amounts. It is the choice of delays which determines the sound field achieved when the output transducers (104) output the various delayed versions of the input signal (101). The delayed and preferably otherwise modified replicas are output from the Distributor (102) via output terminals (1516).

As already mentioned, the choice of respective delays carried by each signal delay means (1508) and/or each adjustable digital filter (1512) critically influences the type of sound field which is achieved. In general, there are four particularly advantageous sound fields which can be linearly combined.

First Sound Field

Figure 7A:
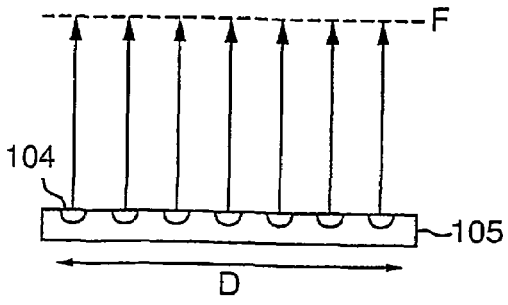
FIGS. 7A to 7D show four types of sound field which may be achieved using the apparatus of the first aspect of the present invention.

A first sound field is shown in FIG. 7A.

The array (105) comprising the various output transducers (104) is shown in plan view. Other rows of output transducers may be located above or below the illustrated row.

The delays applied to each replica by the various signal delay means (508) are set to be the same value, eg 0 (in the case of a plane array as illustrated), or to values that are a function of the shape of the Surface (in the case of curved surfaces). This produces a roughly parallel "beam" of sound representative of the input signal (101), which has a wave front F parallel to the array (105). The radiation in the direction of the beam (perpendicular to the wave front) is significantly more intense than in other directions, though in general there will be "side lobes" too. The assumption is that the array (105) has a physical extent which is one or several wavelengths at the sound frequencies of interest. This fact means that the side lobes can generally be attenuated or moved if necessary by adjustment of the ACMs or ADFs.

The mode of operation may generally be thought of as one in which the array (105) mimics a very large traditional loudspeaker. All of the individual transducers (104) of the array (105) are operated in phase to produce a symmetrical beam with a principle direction perpendicular to the plane of the array. The sound field obtained will be very similar to that which would be obtained if a single large loudspeaker having a diameter D was used.

Second Sound Field

The first sound field might be thought of as a specific example of the more general second sound field.

Figure 7B:
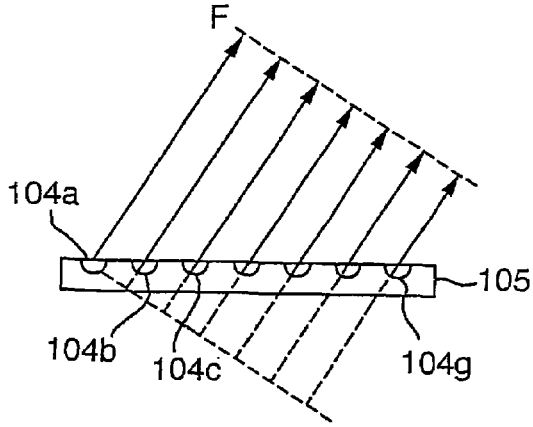

Here, the delay applied to each replica by the signal delay means (1508) or adjustable digital filter (1512) is made to vary such that the delay increases systematically amongst the transducers (104) in some chosen direction across the surface of the array. This is illustrated in FIG. 7B. The delays applied to the various signals before they are routed to their respective output transducer (104) may be visualised in FIG. 7B by the dotted lines extending behind the transducer. A longer dotted line represents a longer delay time. In general, the relationship between the dotted lines and the actual delay time will be $d_n=t_n*c$ where d represents the length of the dotted line, t represents the amount of delay applied to the respective signal and c represents the speed of sound in air.

As can be seen from FIG. 7B, the delays applied to the output transducers increase linearly as you move from left to right in FIG. 7B. Thus, the signal routed to the transducer (104*a*) has substantially no delay and thus is the first signal to exit the array. The signal routed to the transducer (104*b*) has a small delay applied so this signal is the second to exit the array. The delays applied to the transducers (104*c*, 104*d*, 104*e* etc) successively increase so that there is a fixed delay between the outputs of adjacent transducers.

Such a series of delays produces a roughly parallel "beam" of sound similar to that produced for the first sound field except that now the beam is angled by an amount dependent on the amount of systematic delay increase that was used. For very small delays ($t_n<<T_c$, n) the beam direction will be very nearly orthogonal to the array (105); for larger delays (max $t_n$)~$T_c$ the beam can be steered to be nearly tangential to the surface.

As already described, sound waves can be directed without focussing by choosing delays such that the same temporal parts of the sound waves (those parts of the sound waves representing the same information) from each transducer together form a front F travelling in a particular direction.

By reducing the amplitudes of the signals presented by a Distributor to the SETs located closer to the edges of the array (relative to the amplitudes presented to the SETs closer to the middle of the array), the level of the side lobes (due to the finite array size) in the radiation pattern may be reduced. For example, a Gaussian or raised cosine curve may be used to determine the amplitudes of the signals from each SET. A trade off is achieved between adjusting for the effects of finite array size and the decrease in power due to the reduced amplitude in the outer SETs.

Third Sound Field

If the signal delay applied by the signal delay means (1508) and/or the adaptive digital filter (1512) is chosen such that the sum of the delay plus the sound travel time from that SET (104) to a chosen point in space in front of the DPAA are for all of the SETs the same value—ie. so that sound waves arrive from each of the output transducers at the chosen point as in-phase sounds—then the DPAA may be caused to focus sound at that point, P. This is illustrated in FIG. 7C.

Figure 7C:
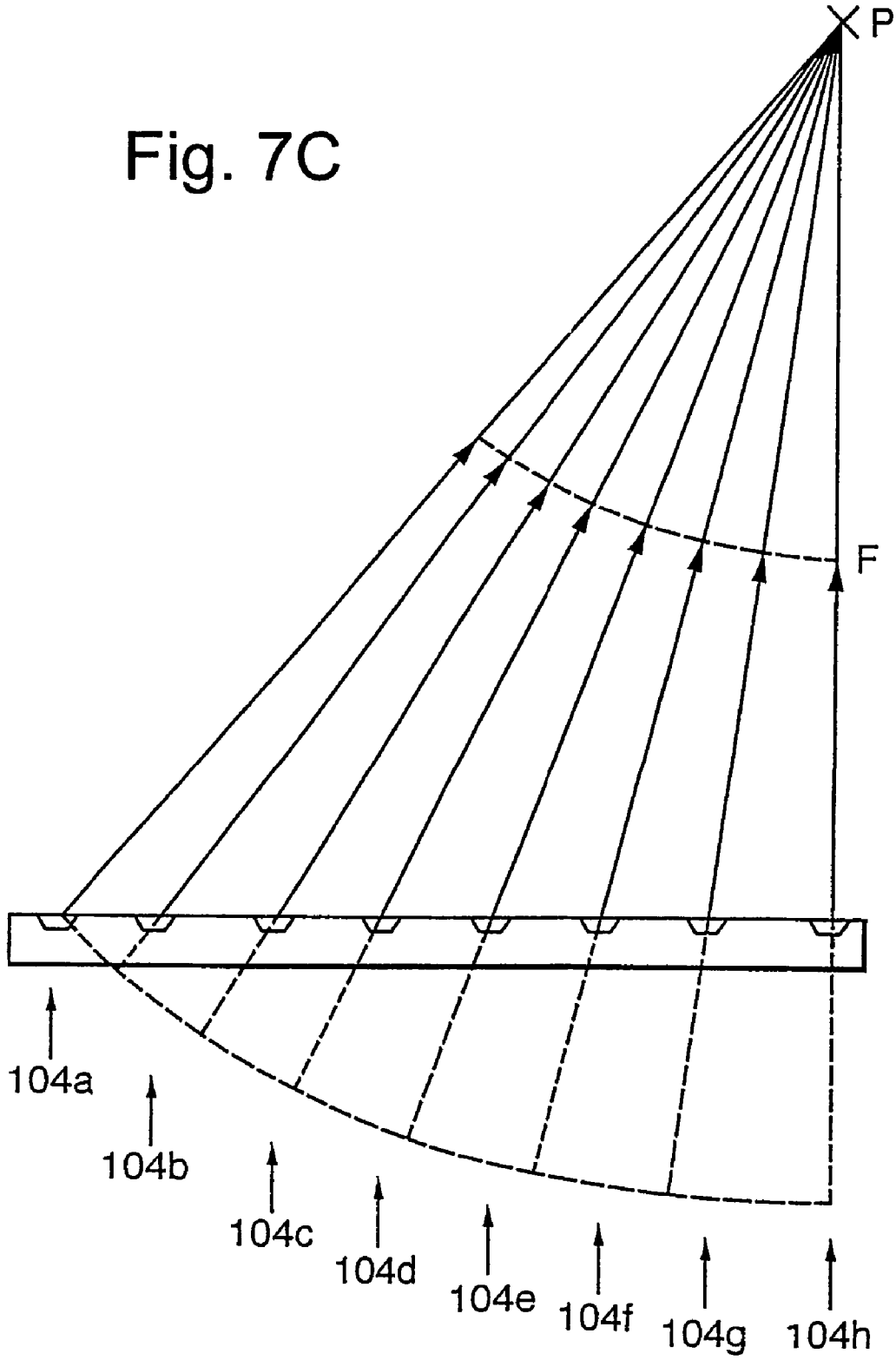

As can be seen from FIG. 7C, the delays applied at each of the output transducers (104*a* through 104*h*) again increase, although this time not linearly. This causes a curved wave front F which converges on the focus point such that the sound intensity at and around the focus point (in a region of dimensions roughly equal to a wavelength of each of the spectral components of the sound) is considerably higher than at other points nearby.

The calculations needed to obtain sound wave focussing can be generalised as follows:— focal point position vector, $$f = \begin{bmatrix} f_x \\ f_y \\ f_z \end{bmatrix}$$

nth transducer position, $$p_n = \begin{bmatrix} p_{nx} \\ p_{ny} \\ p_{nz} \end{bmatrix}$$

transit time for nth transducer, $$t_n = \frac{1}{c}\sqrt{(f - p_n)^T (f - p_n)}$$

required delay for each transducer, $d_n = k - t_n$ where k is a constant offset to ensure that all delays are positive and hence realisable.

The position of the focal point may be varied widely almost anywhere in front of the DPAA by suitably choosing the set of delays as previously described.

Fourth Sound Field

Figure 7D:
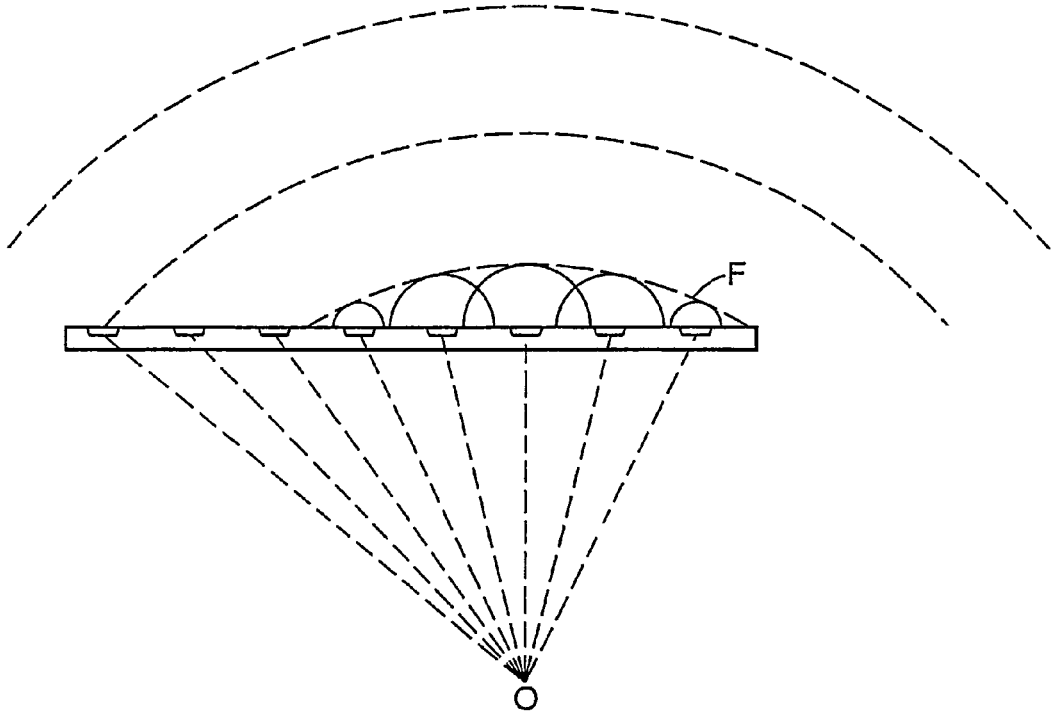

FIG. 7D shows a fourth sound field wherein yet another rationale is used to determine the delays applied to the signals routed to each output transducer. In this embodiment, Huygens wavelet theorem is invoked to simulate a sound field which has an apparent origin O. This is achieved by setting the signal delay created by the signal delay means (1508) or the adaptive digital filter (1512) to be equal to the sound travel time from a point in space behind the array to the respective output transducer. These delays are illustrated by the dotted lines in FIG. 7D.

It will be seen from FIG. 7D that those output transducers located closest to the simulated origin position output a signal before those transducers located further away from the origin position. The interference pattern set up by the waves emitted from each of the transducers creates a sound field which, to listeners in the near field in front of the array, appears to originate at the simulated origin.

Hemispherical wave fronts are shown in FIG. 7D. These sum to create the wave front F which has a curvature and direction of movement the same as a wave front would have if it had originated at the simulated origin. Thus, a true sound field is obtained. The equation for calculating the delays is now:—

$$d_n = t_n - j$$

where $t_n$ is defined as in the third embodiment and j is an arbitrary offset.

It can be seen, therefore, that the general method utilised involves using the replicator (1504) to obtain N replica signals, one for each of the N output transducers. Each of these replicas are then delayed (perhaps by filtering) by respective delays which are selected in accordance with both the position of the respective output transducer in the array and the effect to be achieved. The delayed signals are then routed to the respective output transducers to create the appropriate sound field.

The distributor (102) preferably comprises separate replicating and delaying means so that signals may be replicated and delays may be applied to each replica. However, other configurations are included in the present invention, for example, an input buffer with N taps may be used, the position of the tap determining the amount of delay.

The system described is a linear one and so it is possible to combine any of the above four effects by simply adding together the required delayed signals for a particular output transducer. Similarly, the linear nature of the system means that several inputs may each be separately and distinctly focussed or directed in the manner described above, giving rise to controllable and potentially widely separated regions where distinct sound fields (representative of the signals at the different inputs) may be established remote from the DPAA proper. For example, a first signal can be made to appear to originate some distance behind the DPAA and a second signal can be focussed on a position some distance in front of the DPAA.

First Aspect of the Invention

Figure 8:
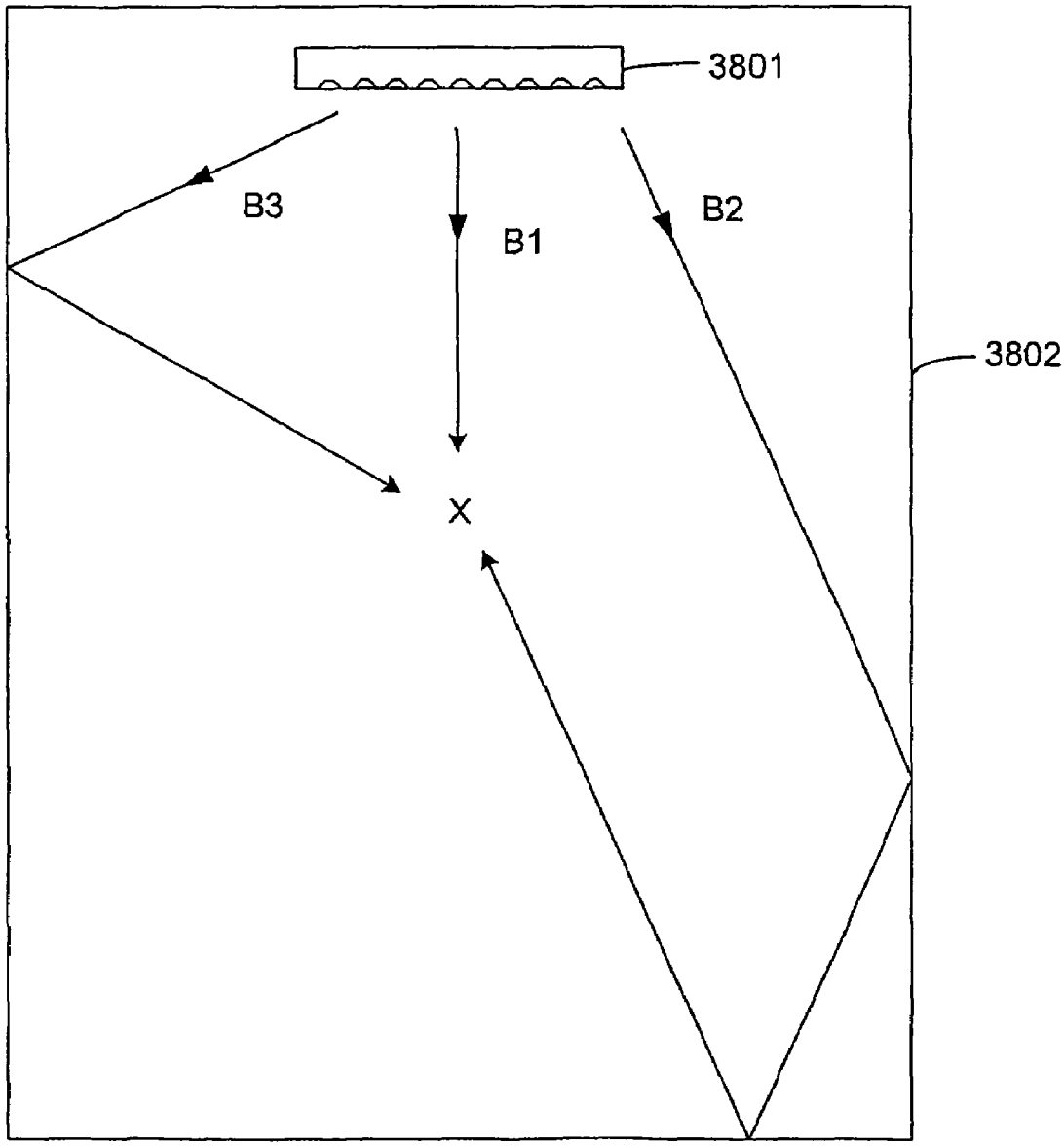
FIG. 8 shows three different beam paths obtained when three sound channels are directed in different directions in a room.

The first aspect of the invention relates to the use of a DPAA in a multichannel system. As already described, different channels may be directed in different directions using the same array to provide special effects. FIG. 8 schematically shows this in plan view the array (3801) is used to direct a first beam of sound (B1) substantially straight ahead towards a listener (X). This can be either focussed or not as shown in FIG. 7A or 7B. A second beam (B2) is directed at a slight angle, so that the beam passes by the listener (X) and undergoes multiple reflections from the walls (3802), eventually reaching the listener again. A third beam (B3) is directed at a stronger angle so that it bounces once of the side wall and reaches the listener. A typical application for such a system is a home cinema system in which Beam B1 represents a centre sound channel, beam B2 represents a right surround (right rear speaker in conventional systems) sound channel and beam B3 represents a left sound channel. Further beams for the right channel and left surround channel may also be present but are omitted from FIG. 8 for clarity. As is evident, the beams travel different distances before reaching the user. For example, the centre beam may travel 4.8 m, the left and right channels may travel 7.8 m and the surround channels travel 12.4 m. To account for this, an extra delay can be applied to the channels which travel the shortest distance so that each channel reaches the user substantially simultaneously.

Figure 9:
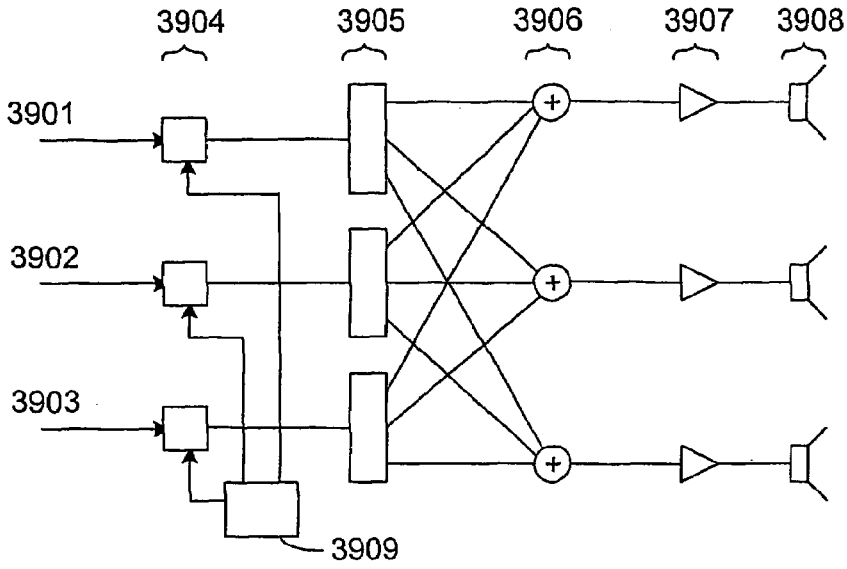
FIG. 9 shows an apparatus for applying a delay to each channel to account for different travelling distances.

Apparatus for achieving this is shown in FIG. 9. Three channels (3901,3902,3903) are input to respective delay means (3904). The delay means (3904) delay each channel in time by an amount determined by a delay controller (3909). The delayed channels then pass to distributors (3905), adders (3906), amplifiers (3907) and output transducers (3908). The distributors (3905) replicate and delay the replicas so as to direct the channels in different directions as shown in FIG. 8. The delay controller (3909) chooses delays based on the expected distance sound waves of that channel will travel before reaching the user. Using the above example, the surround channel travels the furthest and so is not delayed at all. The left channel is delayed by 13.5 ms so it arrives at the same time as the surround channel and the centre channel is delayed by 22.4 ms so that it arrives at the same time as the surround channel and the left channel. This ensures that all channels reach the listener at the same time. If the direction of the channels is changed, the delay controller (3909) can take account of this and adjust the delays accordingly. In FIG. 9, the delay means (3904) are shown before the distributors. However, they may beneficially be incorporated into the distributors so that the delay controller (3909) inputs a signal to each distributor and this delay is applied to all replicated signals output by that distributor. Further, in another practical alternative, there can be used a single delay controller (3909) which chooses the resultant delay for each channel replica and thus sends delay data to each distributor, without the need for separate delaying elements (3904).

Second Aspect of the Invention

Figure 10:
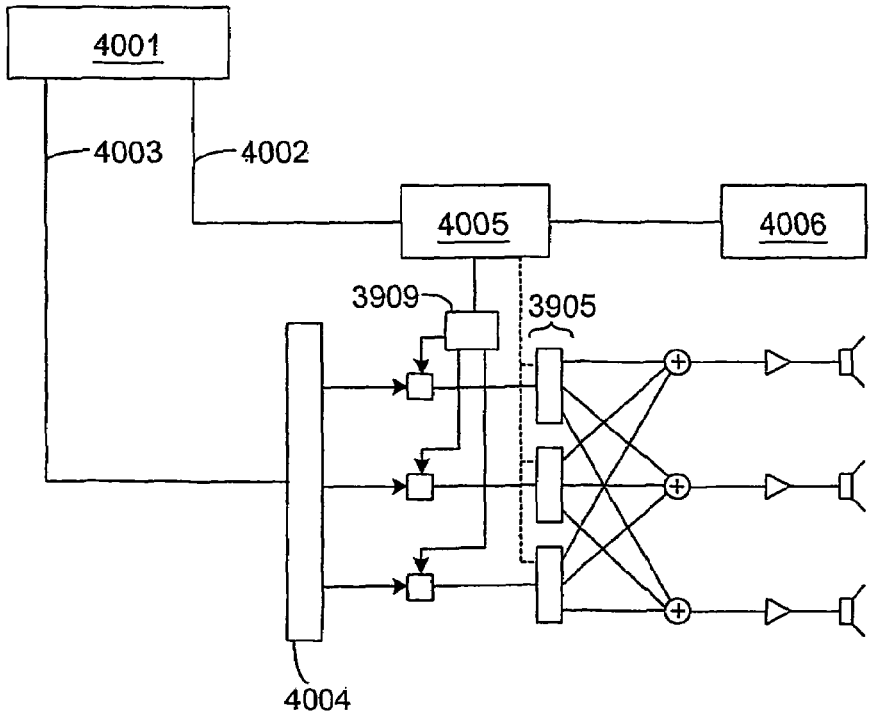
FIG. 10 shows an apparatus for delaying a video signal in accordance with the delays applied to the audio channels.

In the above described first aspect, the delays in the sound reaching the user can be considerable and become more noticeable as they increase in magnitude. For audio-video applications, this can cause the pictures to lead the sound giving an unpleasant effect. This problem can be solved by use of the apparatus shown in FIG. 10. Corresponding audio and video signals are supplied from a source such as a DVD player (4001). These signals are read out simultaneously and have a temporal correspondence. A channel splitter (4004) is used to obtain each channel of audio from the audio signal and each channel is applied to the apparatus shown in FIG. 9. The audio delay controller (3909) is connected to a video delay means (4005) so that the video signal can be delayed by an appropriate amount so that sound and pictures reach the user at the same time. The output from the video delay means is then output to screen means (4006). The video delay applied is generally calculated with reference to the greatest distance traveled by a sound beam, ie the surround channel in FIG. 8. The video delay in this case would be set to be equal to the travel time of beam B2, which is not delayed by audio delay means (3904). It is usually desirable to delay the video signal by an integer number of frames, meaning that the video delay values are only approximately equal to the calculated value. Even the surround channels may undergo some delay due to any processing (eg filtering) they undergo. Thus, a further component may be added to the video delay value to account for this processing delay. Further, it is often simpler to delay the video signal until the sound that reaches the listener on a direct path (eg Beam B1 in FIG. 8) leaves the speaker. The resulting error is generally small, and listeners are accustomed to it from current AV systems. Claims 11 and 16 are intended to cover the system whereby this and approximations due to integer video frames are used, by virtue of the phrase "at substantially the time".

As a refinement, the video delay means can be connected (see dotted line in FIG. 10) as well to each distributor (3905) so that appropriate account can be taken of any delays applied for reasons of beam directivity too. As a further refinement, the video-processing circuitry can be used to provide an on-screen display of the user interface of the sound system. In a more general software embodiment, each component of audio delay would be calculated by a microprocessor as part of a program and a complete delay value would be calculated for each replica. These values would then be used to calculate the appropriate video delay.

Third Aspect of the Invention

Figure 11A:
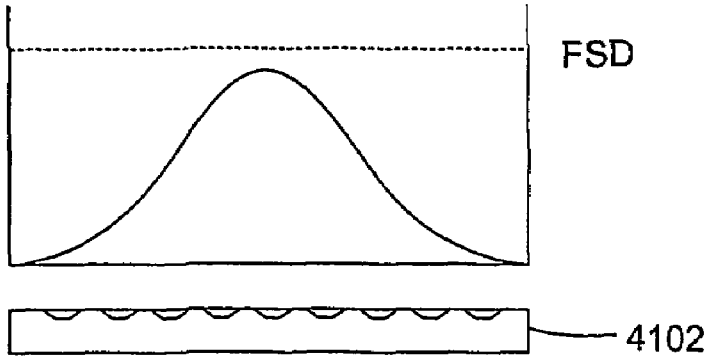
FIGS. 11A to 11D show various window functions used to explain the third aspect of the present invention.
Figure 11B:
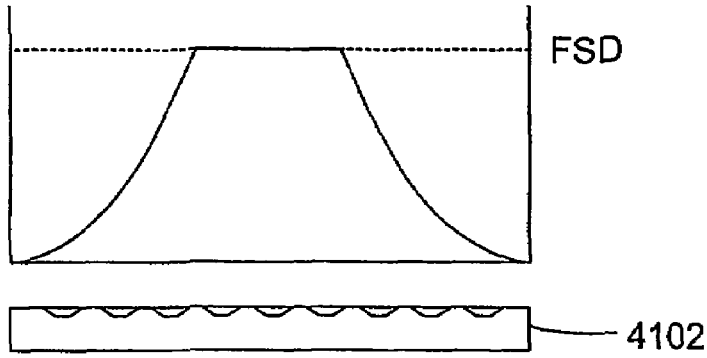
Figure 11C:
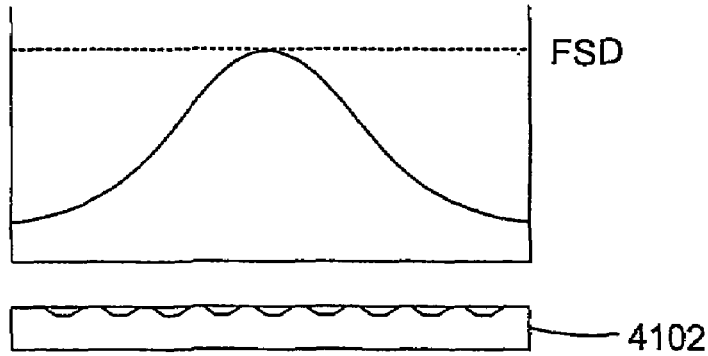
Figure 11D:
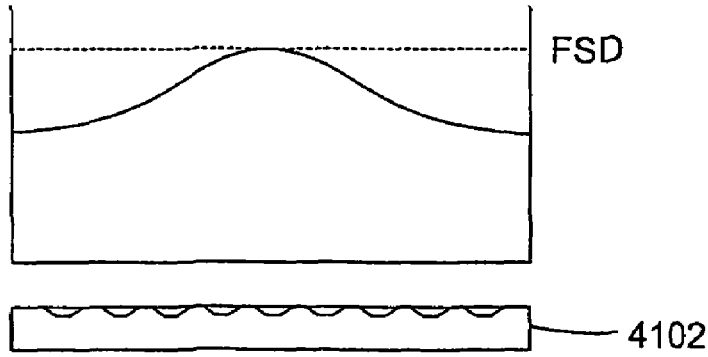

When multiple channels are used, it can be beneficial to apply a different window function to each channel. The window function reduces the effects of "side lobes" at the expense of power. The type of window function used is chosen dependent on the qualities required of the resultant beam. Thus, if beam directivity is important, a window function as is shown in FIG. 11A should be used. If less directivity is required, a more gentle function as shown in FIG. 11D can be used.

Figure 12:
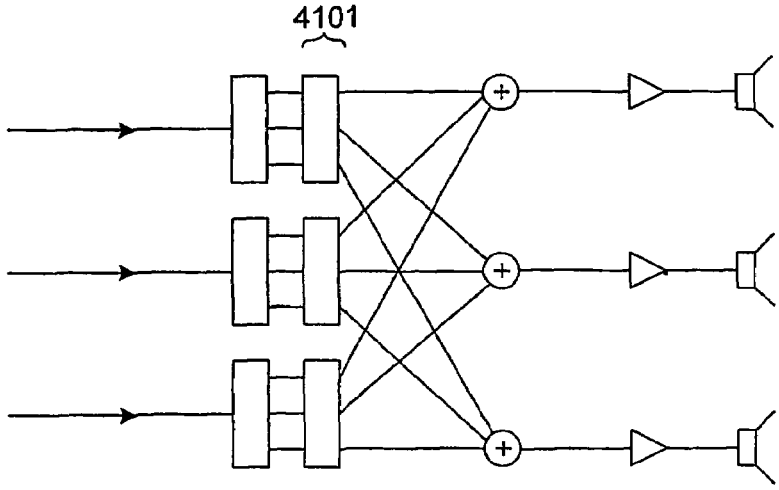
FIG. 12 shows an apparatus for applying different window functions to different channels.

An apparatus for achieving this is shown in FIG. 12. This apparatus is substantially the same as that shown in FIG. 9, except the extra delay means (3904) are omitted. Such extra delay means can be combined with this aspect of the invention however. An extra component (4101) is positioned after the distributors in FIG. 12. This component applies the windowing function. This component can beneficially be combined with the distributors but is shown separately for clarity. The windowing means (4101) applies a window function to the set of replicas for a channel. Thus, the system can be configured so that different window functions are chosen for each channel.

This system has a further advantage. Channels having a high bass content are generally required to have a high level and directivity is not so important. Thus, the window function can be altered for such channels to meet these needs. An example is shown in FIGS. 11A-D. FIG. 11A shows a typical window function. Transducers near the outside of array (4102) have a lower output level than those in the centre to reduce side lobes and improve directivity. If the volume is turned up, all output levels increase and some transducers in the centre of the array may saturate (see FIG. 11B), having reached full scale deflection (FSD). To avoid this, the shape of the window function can be changed instead of merely amplifying the output of each transducer. This is shown in FIGS. 11C and 11D. As the volume is increased, the outer transducers play a greater role in contributing to the overall sound. Although this increases the side lobes, it also increases the power output giving a louder sound, without any clipping (saturation).

The above technique is most important for the higher frequency components. Thus, the present aspect can be combined with the fourth aspect (see later) advantageously. For lower frequencies, where directivity is less attainable and less important a flat ("Boxcar") window function may be used to achieve maximum power output. Also, the changing of the window function to account for increased volume as shown in FIG. 11D is not essential and saturation as shown in FIG. 11B may not in practice appreciably deteriorate quality since the windows still falls off to zero avoiding a discontinuity at the edges and a discontinuity in level is more damaging than a discontinuity in gradient, as shown in FIG. 11B.

Fourth Aspect of the Invention

The directivity achievable with the array is a function of the frequency of the signal to be directed and the size of the array. To direct a low frequency signal, a larger array is necessary than to direct a high frequency signal with the same resolution. Furthermore, low frequencies generally require more power than high frequencies. Thus, it is advantageous to split an input signal into two or more frequency bands and deal with these frequency bands separately in terms of the directivity which is achieved using the DPAA apparatus.

Figure 13:
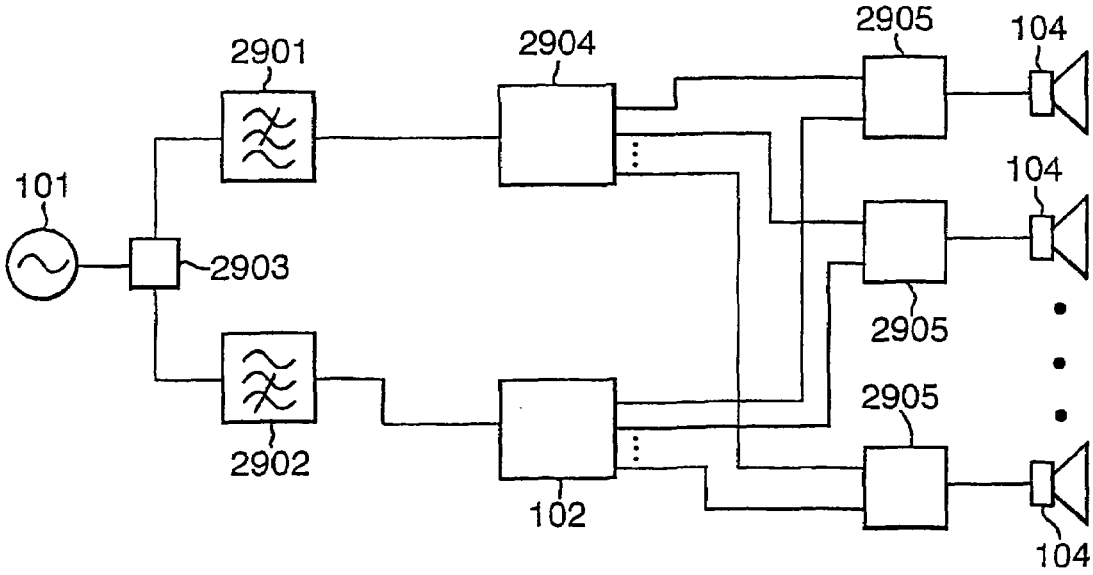
FIG. 13 is a block diagram showing apparatus capable of shaping different frequencies in different ways.

FIG. 13 illustrates the general apparatus for selectively beaming distinct frequency bands.

Input signal 101 is connected to a signal splitter/combiner (2903) and hence to a low-pass-filter (2901) and a high-pass-filter (2902) in parallel channels. Low-pass-filter (2901) is connected to a Distributor (2904) which connects to all the adders (2905) which are in turn connected to the N transducers (104) of the DPAA (105).

High-pass-filter (2902) connects to a device (102) which is the same as device (102) in FIG. 1 (and which in general contains within it N variable-amplitude and variable-time delay elements), which in turn connects to the other ports of the adders (2905).

The system may be used to overcome the effect of far-field cancellation of the low frequencies, due to the array size being small compared to a wavelength at those lower frequencies. The system therefore allows different frequencies to be treated differently in terms of shaping the sound field. The lower frequencies pass between the source/detector and the transducers (2904) all with the same time-delay (nominally zero) and amplitude, whereas the higher frequencies are appropriately time-delayed and amplitude-controlled for each of the N transducers independently. This allows anti-beaming or nulling of the higher frequencies without global far-field nulling of the low frequencies.

It is to be noted that the method according to the fourth aspect of the invention can be carried out using the adjustable digital filters (512). Such filters allow different delays to be accorded to different frequencies by simply choosing appropriate values for the filter coefficients. In this case, it is not necessary to separately split up the frequency bands and apply different delays to the replicas derived from each frequency band. An appropriate effect can be achieved simply by filtering the various replicas of the single input signal.

Figure 14:
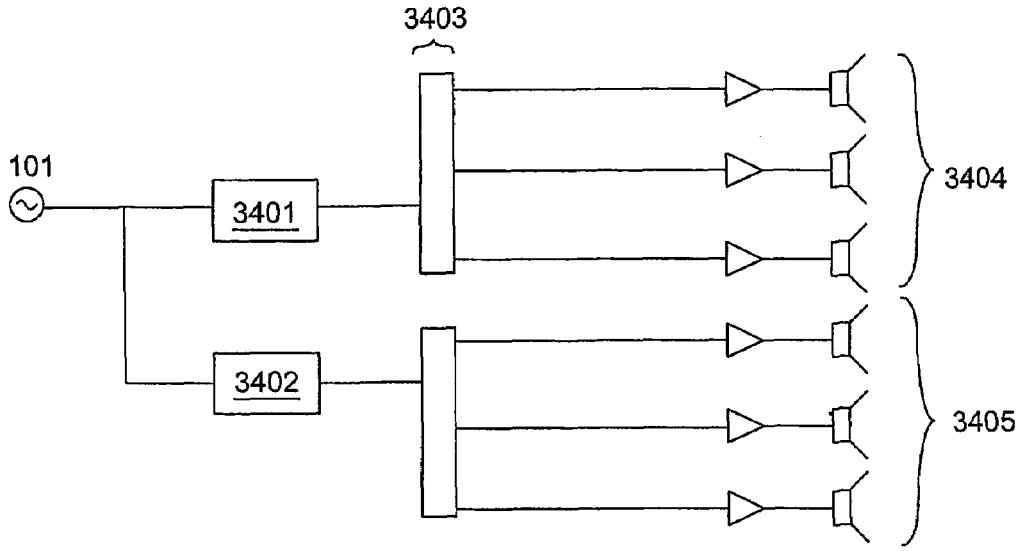
FIG. 14 shows an apparatus for routing different frequency bands to separate output transducers.

FIG. 14 shows another embodiment of this aspect in which different sets of output transducers of the array are used to transmit different frequency bands of the input signal (101). As in FIG. 13, the input signal (101) is split into a high frequency band by a high pass filter (3402) and a low frequency band by a low pass filter (3405). The low frequency signal is routed to a first set of transducers (3404) and the high frequency band is routed to a second set of transducers (3405). The first set of transducers (3404) span a larger physical extent of the array than the high frequency transducers (3405) do. Typically, the extent (that is, the magnitude of a characteristic dimension) spanned by a set of transducers is roughly proportional to the shortest wavelength to be transmitted. This gives roughly equal directivity for both (or all if more than two) frequency bands.

Figure 15:
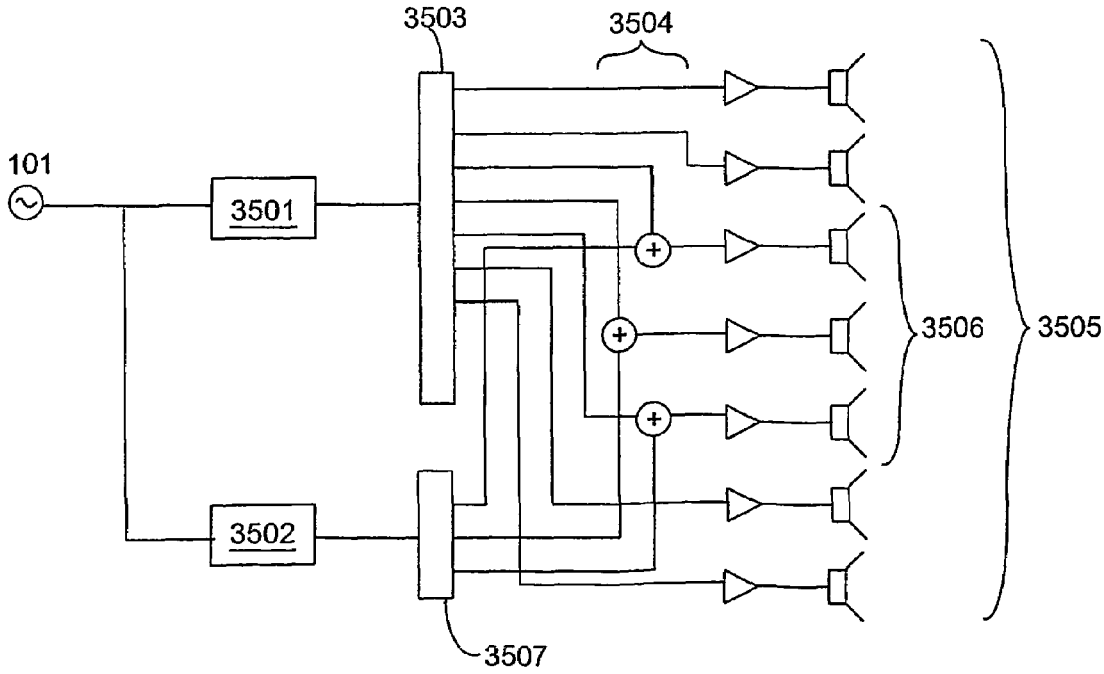
FIG. 15 shows an apparatus for routing different frequency bands to overlapping sets of output transducers.

FIG. 15 shows a further embodiment of this aspect in which some output transducers are shared between bands. Again, the signal is split into low and high frequency components by lowpass filter (3501) and a high pass filter (3502). The low frequency distributor (3503) routes appropriately delayed replicas of the low frequency component of the input signal to a first set of the output transducers (3505). In this example, this first set comprises all the transducers in the array. The high frequency distributor routes the high frequency component of the input signal to a second set of output transducers (3506). These transducers are a subset of the whole array and, as shown in the Figure, may be the same ones as are used to output the low frequency component. In this case, adders (3504) are required to add the low frequency and high frequency signals prior to output. Thus, in this embodiment, more transducers are used to output the low frequency component and thus more power can be achieved where it is needed at the low frequencies. To further improve the power output at low frequencies, the outer transducers (which output solely low frequencies) can be larger and more powerful.

This method has the advantage that the directivity achieved is the same across all frequencies and a minimum of transducers are used for the high frequencies, resulting in decreased complexity and cost. This is especially the case when a set-up such as is shown in FIG. 14 is used, with low-frequency specific transducers around the outside of the array and high frequency transducers near the centre. This has the further advantage that cheaper limited range transducers may be used rather than full-range transducers.

Figure 16:
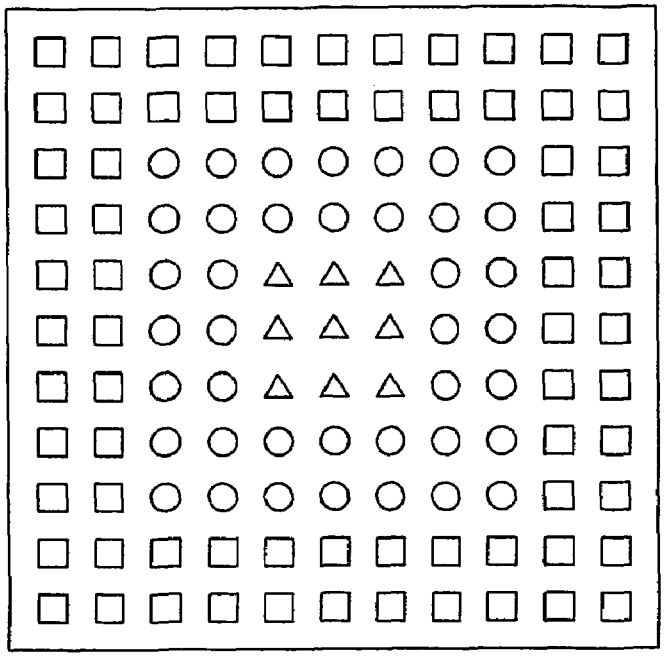
FIG. 16 shows a front view of an array with symbols representing the frequency bands which each transducer outputs.

FIG. 16 shows schematically a front view of an array of transducers, each symbol representing a transducer (note the symbols are not intended to relate in any way to the shape of the transducers used). When the method of FIG. 14 is used, the square symbols represent transducers which are used to output low frequency components. The circle symbols represent transducers which output mid-range components and the triangle symbols represent transducers which output high frequency components.

When the method of FIG. 15 is used, the triangle symbols represent transducers which output components of all three frequency ranges. The circle symbols represent transducers which output only mid-range and low frequency signals and the square symbols represent transducers which output only low frequencies.

This aspect of the invention is fully compatible with the above-described third aspect since windowing functions can be used, with the calculation taking place after the distributors (3403, 3503,3507). When dedicated transducers are used (as in FIG. 14), the "hole" in the low frequency window function caused by the presence of a centre array of high frequency transducers is not usually detrimental to performance, especially if the hole is sufficiently small with respect to the shortest wavelengths reproduced by the low frequency channel.

Figure 17:
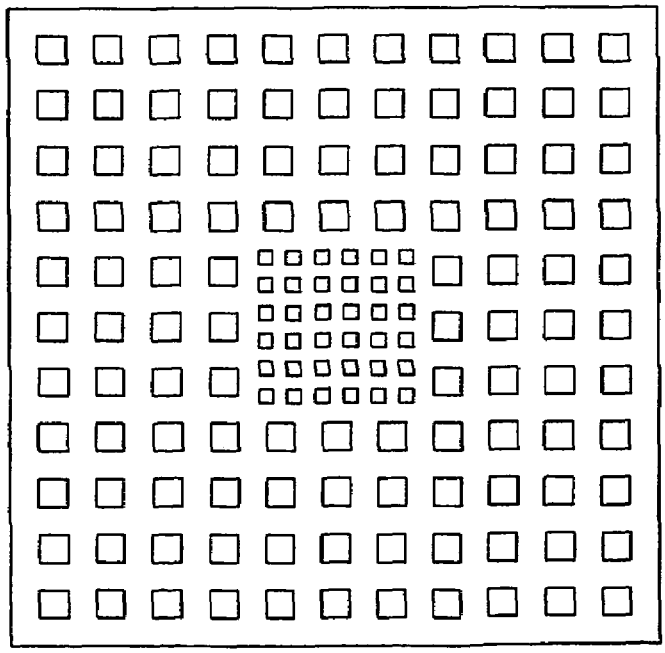
FIG. 17 shows an array of output transducers having a denser region of transducers near the centre, in accordance with the fourth aspect of the invention.

It is evident from FIG. 16 that less transducers are used for the high frequencies than for the low frequencies and that the spacing between adjacent transducers is constant. However, the maximum acceptable transducer spacing is a function of wavelength so that to avoid sidelobes at high frequencies requires more tightly packed (eg every $\lambda/2$) transducers. This makes it expensive in terms of transducers and drive electronics to cover an area large enough to direct low frequencies on the one hand but with tightly spaced transducers to direct high frequencies on the other hand. To solve this problem, an array as shown in FIG. 17 is provided. This array has a higher than average density of output transducers located near the centre portion. Thus, more closely packed transducers can be used to output the high frequencies without increasing the extent of the array and thus the directivity of the beam. The large low frequency area is covered by less closely packed transducers whereas the central high frequency area has a more tightly packed area, optimising cost and performance at all frequencies. In FIG. 17, the squares merely show the presence of a transducer and not the shape or the type of signal output, as in FIG. 16.

Fifth Aspect of the Invention

Figure 18:
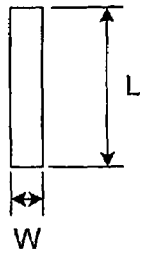
FIG. 18 shows a single transducer having an elongate structure.
Figure 19:
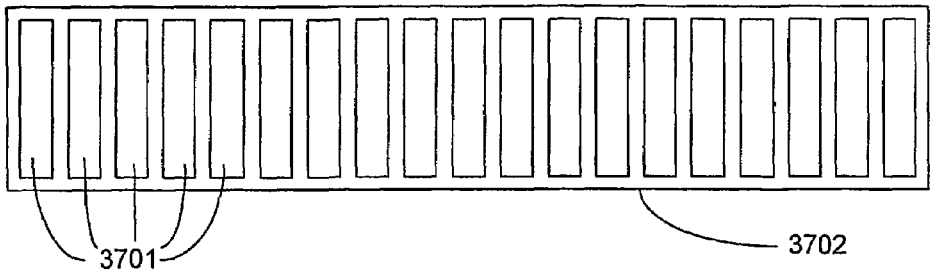
FIG. 19 shows an array of the transducers shown in FIG. 18.

FIG. 18 shows a transducer having a length L longer than its width W. This transducer can advantageously be used in an array of like transducers as shown in FIG. 19. Here, the transducers 3701 are positioned next to one another in a line such that the line extends in the perpendicular direction to the longest side of each transducer. This arrangement provides a sound field which can be directed well in the horizontal plane and which, thanks to the elongated shape of each transducer, has most of its energy in the horizontal plane. There is very little sound energy directed to other planes resulting in good efficiency of operation. Thus, the fifth aspect provides a 1-dimensional array made of elongated transducers which gives tight directivity in one direction (thanks to the elongated shape) and controllable directivity in the other (thanks to the array nature). The aspect ratio of each transducer is preferably at least 2:2, more preferably 3:1 and more preferably still 5:1. The elongate nature of each transducer causes the effect of sound being concentrated in a plane whereas the array of transducers in a line gives good directivity within the plane. This array may be used as the array in any of the other aspects of the invention.

Sixth Aspect of the Invention

The sixth aspect of the invention relates to the use of a DPAA system to create a surround sound or stereo effect using only a single sound emitting apparatus similar to the apparatus described above. Particularly, the sixth aspect of the invention relates to directing different channels of sound in different directions so that the soundwaves impinge on a reflective or resonant surface and are re-transmitted thereby.

This sixth aspect of the invention addresses the problem that where the DPAA is operated outdoors (or any other place having substantially anechoic conditions) an observer needs to move close to those regions in which sound has been focussed in order to easily perceive the separate sound fields. It is otherwise difficult for the observer to locate the separate sound fields which have been created.

If an acoustic reflecting surface, or alternatively an acoustically resonant body which re-radiates absorbed incident sound energy, is placed in the path of a sound beam, it re-radiates the sound, and so effectively becomes a new sound source, remote from the DPAA, and located at a region determined by the focussing used (if any). If a plane reflector is used then the reflected sound is predominantly directed in a specific direction; if a diffuse reflector is present then the sound is re-radiated more or less in all directions away from the reflector on the same side of the reflector as the sound is incident from the DPAA. Thus, if a number of distinct sound signals representative of distinct input signals are directed towards distinct regions by the DPAA in the manner described, and within each region is placed such a reflector or resonator so as to redirect the sound from each region, then a true multiple separated-source sound radiator system may be constructed using a single DPAA of the design described herein.

Figure 20:
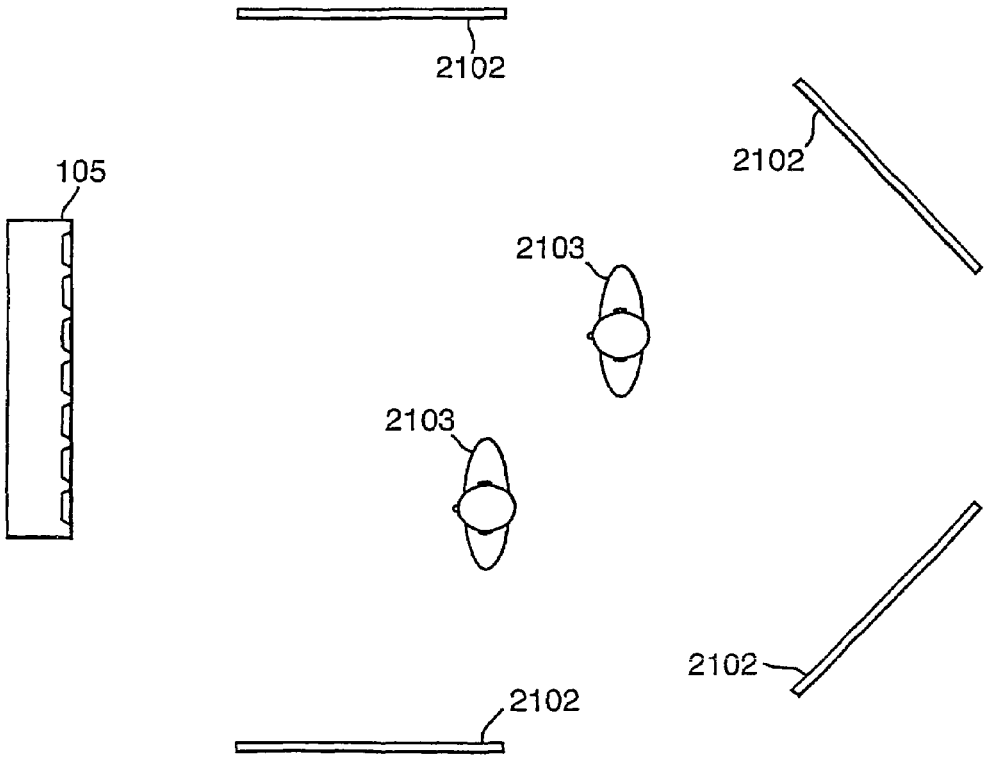
FIG. 20 shows a plan view of an array of output transducers and reflective/resonant screens to achieve a surround sound effect.

FIG. 20 illustrates the use of a single DPAA and multiple reflecting or resonating surfaces (2102) to present multiple sources to listeners (2103). As it does not rely on psychoacoustic cues, the surround sound effect is audible throughout the listening area.

Figure 21:
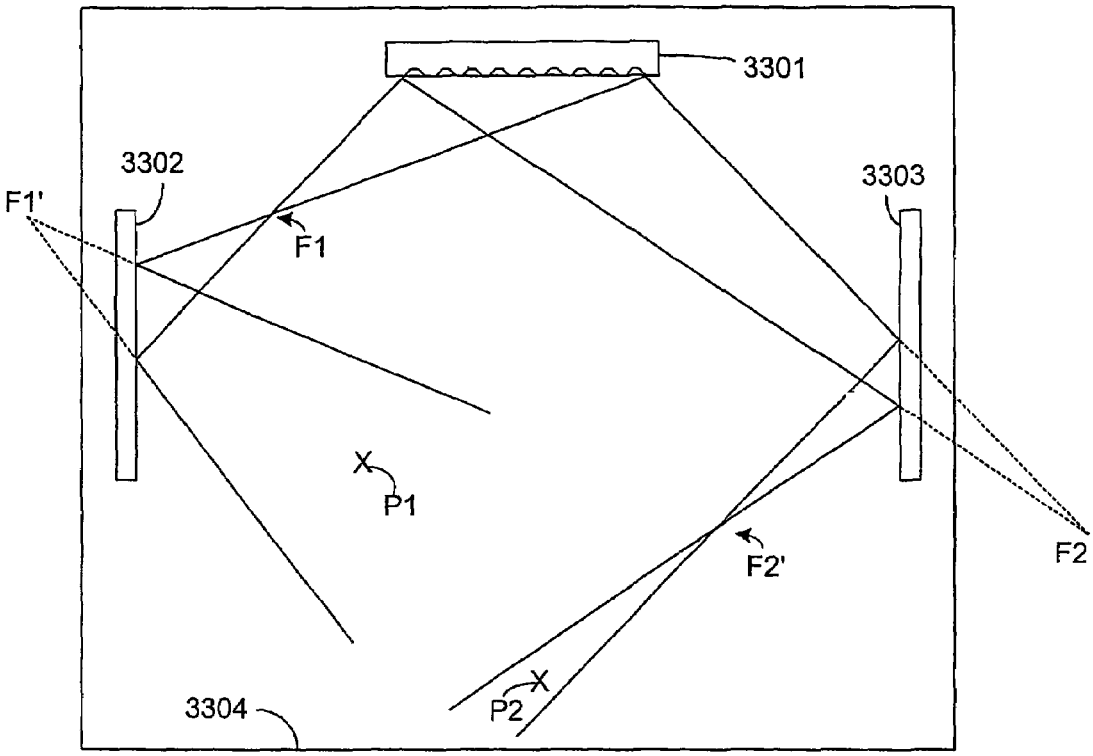
FIG. 21 shows a plan view of an array of transducers and reflective/resonant surfaces, with beam patterns being reflected from the surfaces.

The sound beams may be unfocussed, as described above with reference to FIG. 7A or 7B, or focussed, as described above with reference to FIG. 7C. The focus position can be chosen to be either in front of, at, or behind the respective reflector/resonator to achieve the desired effect. FIG. 21 schematically shows the effect achieved when a sound beam is focussed in front of and behind a reflector respectively. The DPAA (3301) is operable to direct sound towards the reflectors (3302 & 3303) set up in a room (3304).

In the case when a sound beam is focussed in front of a reflector (3302) at a point F1 (See FIG. 21), the beam narrows at the focus point and spreads out thereafter. The beam continues to spread after reflection from reflector and a listener at position P1 will hear the sound. Due to the reflection, the user will perceive the sound as emanating from the ghost focal point F1'. Thus the listener at P1 will perceive the sound as emanating from outside the room (3304). Further, the beam obtained is quite broad so that a large proportion of listeners in the bottom half of the room (3304) will hear the sound.

In the case when a sound beam is focussed behind a reflector (3303) at a point F2 (See FIG. 21), the beam is reflected before it has fully narrowed to the focus point. After reflection, the beam spreads out and a listener at position P2 will be able hear the sound. Due to the reflection, the user will perceive the sound as emanating from the reflected focal point F2' in front of the reflector. Thus the listener at P1 will perceive the sound as emanating from close by. Further, the beam obtained is quite narrow so that it is possible to direct sound to a smaller proportion of the listeners in the room. Thus, it can be advantageous for the above reasons to focus the beams at positions other than the reflector/resonator.

Where the DPAA is operated in the manner previously described with multiple separated beams—ie. with sound signals representative of distinct input signals directed to distinct and separated regions—in non-anechoic conditions (such as in a normal room environment) wherein there are multiple hard and/or predominantly sound reflecting boundary surfaces, and in particular where those regions are directed at one or more of the reflecting boundary surfaces, then using only his normal directional sound perceptions an observer is easily able to perceive the separate sound fields, and simultaneously locate each of them in space at their respective separate focal regions (if there is one), due to the reflected sounds (from the boundaries) reaching the observer from those regions.

It is important to emphasise that in such a case the observer perceives real separated sound fields which in no way rely on the DPAA introducing artificial psycho-acoustic elements into the sound signals. Thus, the position of the observer is relatively unimportant for true sound location, so long as he is sufficiently far from the near-field radiation of the DPAA. In this manner, multi-channel "surround-sound" can be achieved with only one physical loudspeaker (the DPAA), making use of the natural boundaries found in most real environments.

Where similar effects are to be produced in an environment lacking appropriate natural reflecting boundaries, similar separated multi-source sound fields can be achieved by the suitable placement of artificial reflecting or resonating surfaces where it is desired that a sound source should seem to originate, and then directing beams at those surfaces. For example, in a large concert hall or outside environment optically-transparent plastic or glass panels could be placed and used as sound reflectors with little visual impact. Where wide dispersion of the sound from those regions is desired, a sound scattering reflector or broadband resonator could be introduced instead (this would be more difficult but not impossible to make optically transparent).

A spherical reflector can be used to achieve diffuse reflection over a wide angle. To further enhance the diffuse reflection effect, the surfaces should have a roughness on the scale of the wavelength of sound frequency it is desired to diffuse.

The great advantage of this aspect of the present invention is that all of the above may be achieved with a single DPAA apparatus, the output signals for each transducer being built up from summations of delayed replicas of input signals. Thus, much wiring and apparatus traditionally associated with surround sound systems is dispensed with.

Seventh Aspect of the Invention

The seventh aspect of the invention addresses the problem that a user of the DPAA system may not always be easily able to locate where sound of a particular channel is being directed or focussed at any particular time. Conversely, the user may want to direct or focus sound at a particular position in space which requires a complex calculation as to the correct delays to apply etc. This problem is alleviated by providing a video camera means which can be caused to point in a particular direction. Means connected to the video camera can then be used to calculate which direction the camera is pointing in and adjust the delays accordingly. Advantageously, the camera is under the direct control of the operator (for example on a tripod or using a joystick) and the DPAA controller is arranged to cause sound channel directing to occur wherever the operator causes the camera to point. This provides a very easy to set up system which does not rely on creating mathematical models of the room or other complex calculations.

Advantageously, means may be provided to detect where in the room the camera is focussed. Then, the sound beams can be focussed on the same spot. This makes setting up a system very simple since markers can be placed in a room where sound is desired to be focussed and then a camera lens can be focussed on these markers by an operator looking at a television monitor. The system can then automatically set up the software to calculate the correct delays for focussing sound to that spot. Alternatively, reference points in the room can be identified to select sound focussing. For example, a simple model of the room can be pre-programmed so that an operator can select objects in the field of view of the camera so determine the focussing distance. In both the case when the camera focus distance is used and when a room model is used, it is advantageous to employ a coordinate transform from camera (pan, tilt, distance) or room (x,y,z) to speaker (rotation, elevation, distance), where the two coordinate systems have different origins.

In the reverse mode of operation, the camera may be steered automatically by the DPAA electronics such that it points toward the direction in which a beam is currently being steered, with an automatic focussing on the point where sound focussing occurs, if at all. This provides a great deal of useful set-up feedback information to the operator.

Means to select which channel settings are controlled by the camera position should also be provided and these may all be controlled from the handset.

Figure 22:
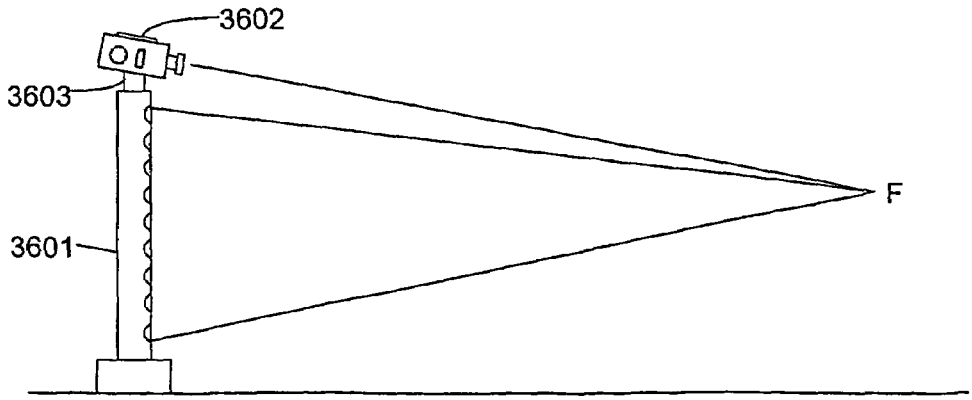
FIG. 22 shows a side view of an array having a video camera attached in accordance with the seventh aspect of the invention.

FIG. 22 illustrates in side view the use of a video camera (3602) positioned on a DPAA (3601) to point at the same point in which sound is focussed. The camera can be steerable using a servo motor (3603). Alternatively, the camera can be mounted on a separate tripod or be hand held or be part of an extant CCTV system.

For CCTV applications, where a plurality of cameras are used to cover an area, a single array can be used to direct sound to any position in the area which one of the cameras is pointing at. Thus, an operator can direct sound (such as voice commands or instructions) to a specific point in the area/room by selecting a camera pointing at that point and speaking into a microphone.

Further Preferable Features

There may be provided means to adjust the radiation pattern and focussing points of signals related to each input, in response to the value of the programme digital signals at those inputs—such an approach may be used to exaggerate stereo signals and surround-sound effects, by moving the focussing point of those signals momentarily outwards when there is a loud sound to be reproduced from that input only. Thus, the steering can be achieved in accordance with the actual input signal itself.

In general, when the focus points are moved, it is necessary to change the delays applied to each replica which involves duplicating or skipping samples as appropriate. This is preferably done gradually so as to avoid any audible clicks which may occur if a large number of samples are skipped at once for example.

Practical applications of this invention's technology include the following:

for home entertainment, the ability to project multiple real sources of sound to different positions in a listening room allows the reproduction of multi-channel surround sound without the clutter, complexity and wiring problems of multiple separated wired loudspeakers;

for public address and concert sound systems, the ability to tailor the radiation pattern of the DPAA in three dimensions, and with multiple simultaneous beams allows:

much faster set-up as the physical orientation of the DPAA is not very critical and need not be repeatedly adjusted;

smaller loudspeaker inventory as one type of speaker (a DPAA) can achieve a wide variety of radiation patterns which would typically each require dedicated speakers with appropriate horns;

better intelligibility, as it is possible to reduce the sound energy reaching reflecting surfaces, hence reducing dominant echoes, simply by the adjustment of filter and delay coefficients; and better control of unwanted acoustic feedback as the DPAA radiation pattern can be designed to reduce the energy reaching live microphones connected to the DPAA input;

for crowd-control and military activities, the ability to generate a very intense sound field in a distant region, which field is easily and quickly repositionable, by focussing and steering of the DPAA beams (without having physically to move bulky loudspeakers and/or horns) and which is easily directed onto the target by means of tracking light sources, and provides a powerful acoustic weapon which is nonetheless non-invasive; if a large array is used, or a group of coordinated separate DPAA panels possibly widely spaced, then the sound field can be made much more intense in the focal region than near the DPAA SETs (even at the lower end of the Audio Band if the overall array dimensions are sufficiently large).

Any of the previously described aspects may be combined together in a practical device to provide the stated advantages.

PREFERRED EMBODIMENT OF THE FIRST ASPECT OF THE INVENTION

There now follows a description of a preferred embodiment of the first aspect of the present invention, which, as will become apparent, utilises also the techniques of the other above-described aspects.

Figure 23:
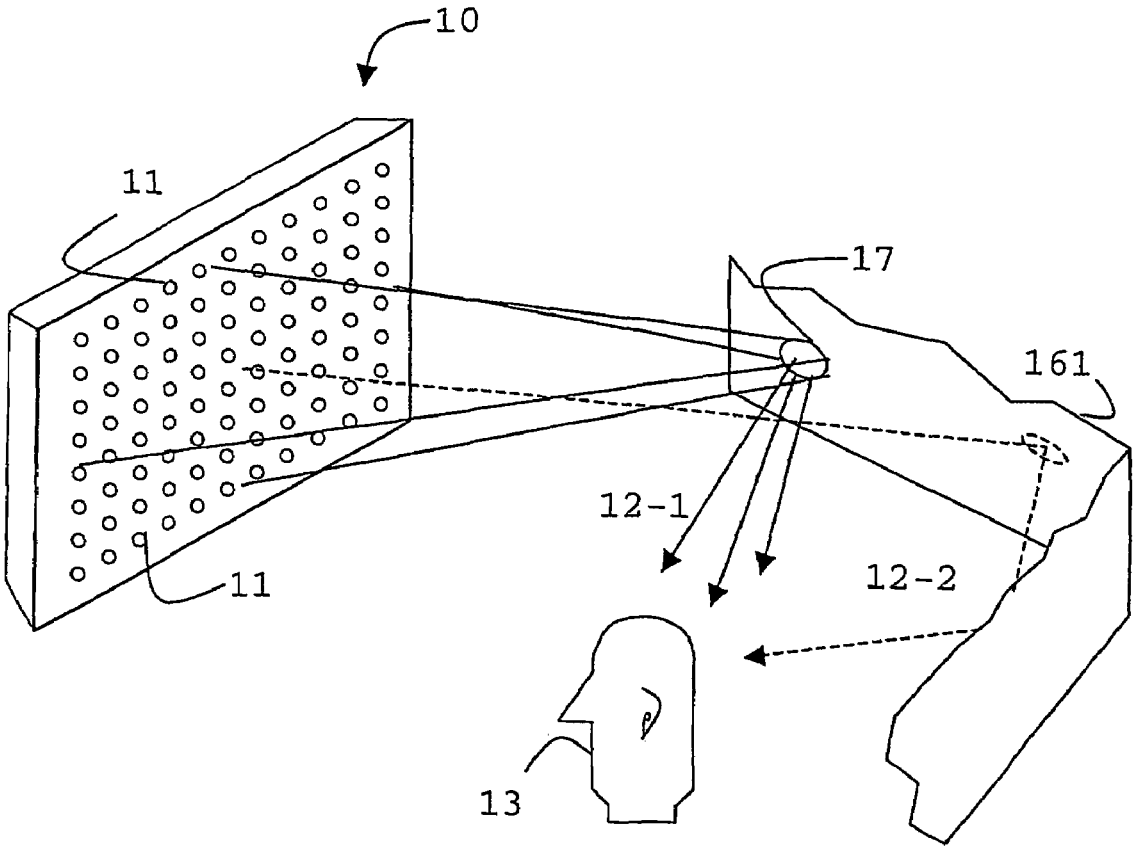
FIG. 23 is a drawing of a typical set-up of a loudspeaker system in accordance with the first aspect of the present invention.

Referring to FIG. 23, a digital sound projector 10 comprises an array of transducers or loudspeakers 11 that is controlled such that audio input signals are emitted as a beam of sound 12-1, 12-2 that can be directed into an—within limits—arbitrary direction within the half-space in front of the array. By making use of carefully chosen reflection paths, a listener 13 will perceive a sound beam emitted by the array as if originating from the location of its last reflection.

In FIG. 23, two sound beams 12-1 and 12-2 are shown. The first beam 12-1 is directed onto a side-wall 161 that may be part of a room and reflected directly onto the listener 13. The listener perceives this beam as originating from reflection spot 17, thus from the right. The second beam 12-2, indicated by dashed lines, undergoes two reflections before reaching the listener 13. However, as the last reflection happens in a rear corner, the listener will perceive the sound as if emitted from a source behind him or her. Whilst there are many uses to which a digital sound projector could be put, it is particularly advantageous in replacing conventional surround-sound systems employing several separate loudspeakers placed at different locations around a listener's position. The digital sound projector, by generating beams for each channel of the surround-sound audio signal, and steering the beams into the appropriate directions, creates a true surround-sound at the listener position without further loudspeakers or additional wiring.

Figure 24:
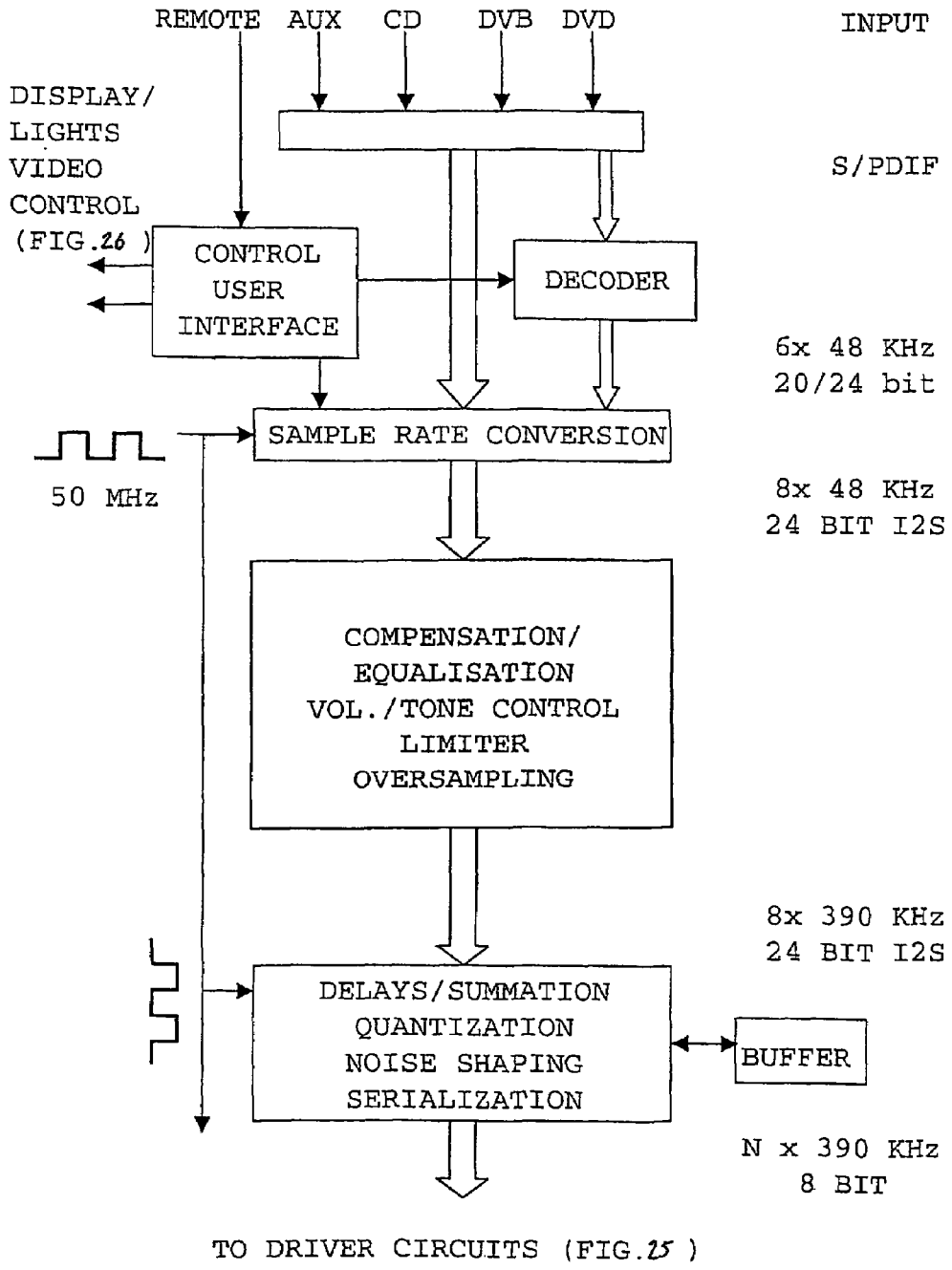
FIG. 24 is a block diagram of a first part of a digital loudspeaker system in accordance with a preferred embodiment of the first aspect of the present invention.
Figure 25:
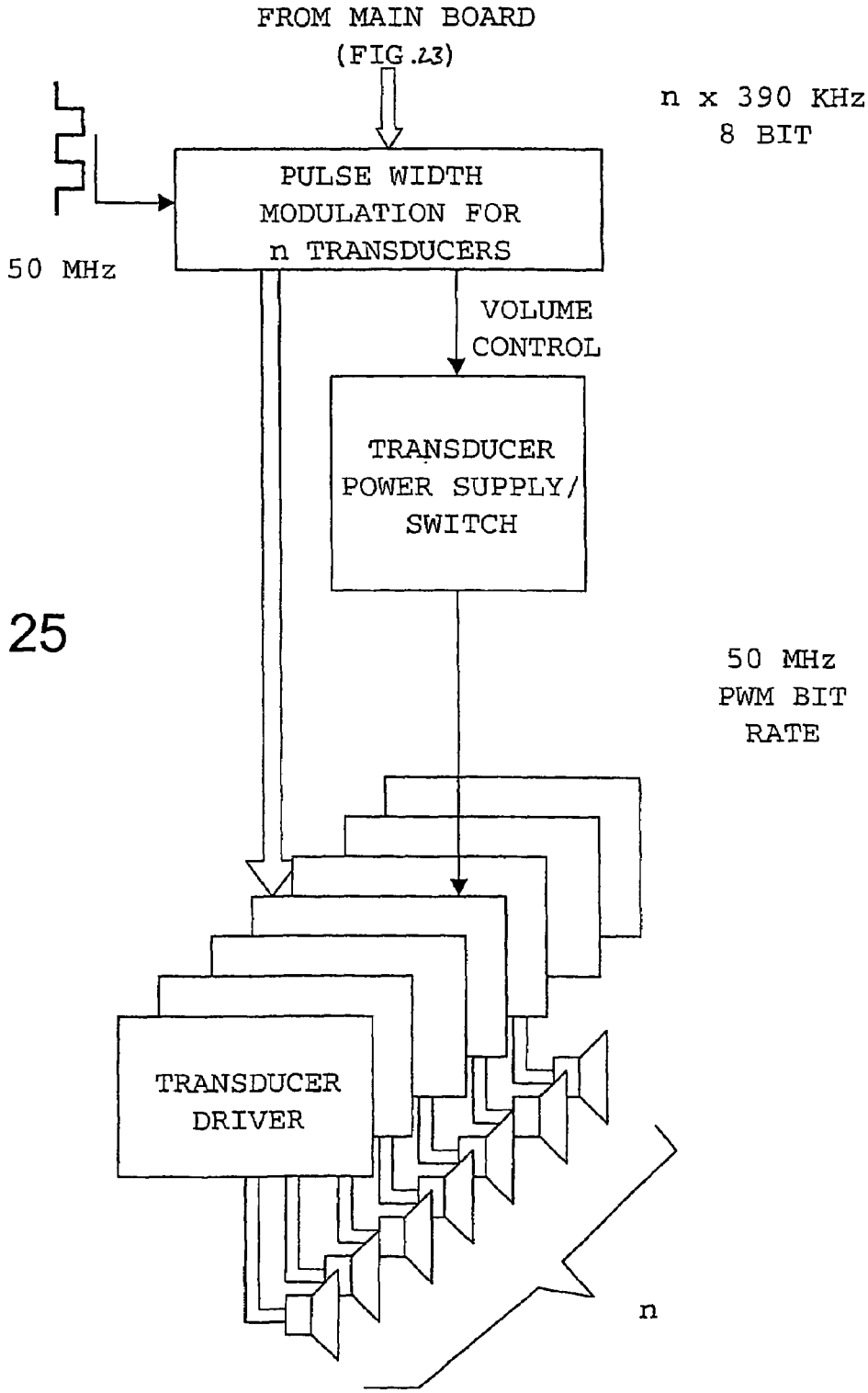
FIG. 25 is a block diagram of a second part of a digital loudspeaker system in accordance with a preferred embodiment of the first aspect of the present invention.
Figure 26:
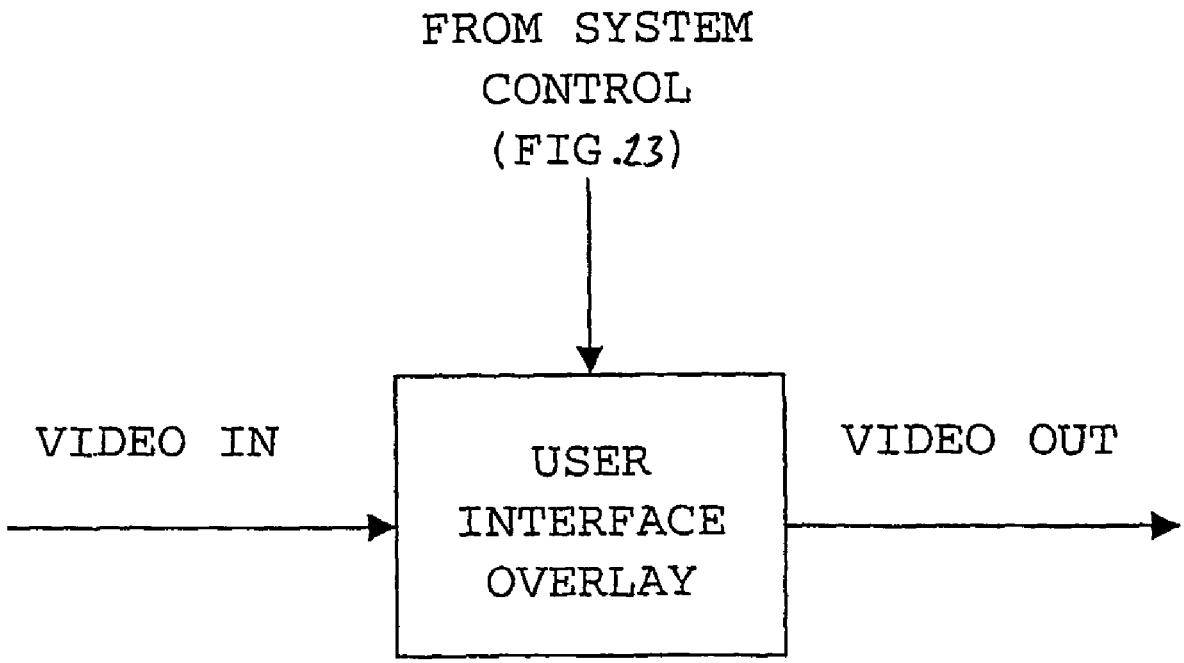
FIG. 26 is a block diagram of a third part of a digital loudspeaker system in accordance with a preferred embodiment of the first aspect of the present invention.

In FIGS. 24 to 26, there are shown components of a digital sound projector system in form of block diagrams. At the input, common-format audio source material in Pulse Code Modulated (PCM) form is received from devices such as compact disks (CDs), digital video disks (DVDs) etc. by the digital sound projector as either an optical or coaxial digital data stream in the S/PDIF format. But other input digital data formats can be also used. This input data may contain either a simple two channel stereo pair, or a compressed and encoded multi-channel soundtrack such as Dolby Digital™5.1 or DTS™, or multiple discrete digital channels of audio information. Encoded and/or compressed multi-channel inputs are first decoded and/or decompressed in a decoder using the devices and licensed firmware available for standard audio and video formats. An analogue to digital converter (not shown) is also incorporated to allow connection (AUX) to analogue input sources which are immediately converted to a suitably sampled digital format. The resultant output comprises typically three, four or more pairs of channels. In the field of surround-sound, these channels are often referred to left, right, centre, surround (rear) left and surround (rear) right channels. Other channel may be present in the signal such as the low frequency effect channel (LFE).

These channels or channel-pairs are each fed into a two-channel sample-rate-converter [SRC] (alternatively each channel can be passed through a single channel SRC) for re-synchronisation and re-sampling to an internal (or optionally, external) standard sample-rate clock [SSC] (typically about 48.8 KHz or 97.6 KHz) and bit-length (typically 24 bit), allowing the internal system clocks to be independent of the source data-clock. This sample rate conversion eliminates problems due to clock speed inaccuracy, clock drift, and clock incompatibility. Specifically, if the final power-output stages of the digital sound projector are to be digital pulse-width-modulation [PWM] switched types for high efficiency, it is desirable to have a complete synchronisation between the PWM-clock and the digital data-clock feeding the PWM modulators. The SRCs provide this synchronisation, as well as isolation from the vagaries of any external data clocks.

Finally, where two or more of the digital input channels have different data-clocks (perhaps because they come from separate digital microphone systems e.g.), then again the SRCs ensure that internally all disparate signals are synchronised.

The outputs of the SRCs are converted to 8 channels of 24 bit words at an internally generated sample rate of 48.8 KHz.

One or more (typically two or three) digital signal processor [DSP] units are used to process the data. These may be e.g. Texas Instruments TMS320C6701 DSPs running at 133 MHz, and the DSPs either perform the majority of calculations in floating-point format for ease of coding, or in fixed-point format for maximum processing speed. Alternatively, especially where fixed-point calculations are being performed, the digital signal processing can be carried out in one or more Field Programmable Gate Array (FPGA) units. A further alternative is a mixture of DSPs and FPGAs. Some or all of the signal processing may alternatively be implemented with customised silicon in the form of an Application Specific Integrated Circuit (ASIC).

A DSP stage performs filtering of the digital audio data input signals for enhanced frequency response equalisation to compensate for the irregularities in the frequency response (i.e. transfer function) of the acoustic output-transducers used in the final stage of the digital sound projector.

The number of separately processed channels may optionally, at this stage (preferably) or possibly at an earlier or later stage of processing, be reduced by combining additively the (one or more) low-frequency-effects [LFE] channel with one or more of the other channels, for example the centre channel, in order to minimise the processing beyond this stage. However, if a separate sub-woofer is to be used with the system or if processing power is not an issue, then the more discrete channels may be maintained throughout the processing chain.

The DSP stage also performs anti-alias and tone control filtering on all eight channels, and a eight-times over-sampling and interpolation to an overall eight-times oversampled data rate, creating 8 channels of 24-bit word output samples at 390 KHz. Signal limiting and digital volume-control is performed in this DSP too.

An ARM microprocessor generates timing delay data for each and every transducer, from real-time beam-steering settings sent by the user to the digital sound projector via infrared remote control. Given that the digital sound projector is able to independently steer each of the output channels (one steered output channel for each input channel, typically 4 to 6), there are a large number of separate delay computations to be performed; this number is equal to the number of output channels times the number of transducers. As the digital sound projector is also able to dynamically steer each beam in real-time, then the computations also need to be performed quickly. Once computed, the delay requirements are distributed to the FPGAs (where the delays are actually applied to each of the streams of digital data samples) over the same parallel bus as the digital data samples themselves.

The ARM core also handles all system initialisation and external communications.

The signal stream enters Xilinx field programmable gate array logic that control high-speed static buffer RAM devices to produce the required delays applied to the digital audio data samples of each of the eight channels, with a discretely delayed version of each channel being produced for each and every one of the output transducers (256 in this implementation).

Apodisation, or array aperture windowing (i.e. graded weighting factors are applied to the signals for each transducer, as a function of each transducer's distance from the centre of the array, to control beam shape) is applied separately in the FPGA to each channel's delayed signal versions. Applying apodisation here allows different output sound beams to have differently tailored beam-shapes. These separately delayed and separately windowed digital sample streams, one for each of 8 channels and for each of 256 transducers making 8×256=2048 delayed versions in total, are then summed in the FPGA for each transducer to create an individual 390 kHz 24-bit signal for each of the 256 transducer elements. The apodisation or array aperture windowing, may optionally be performed after the summing stage for all of the channels at once (instead of for each channel separately, prior to the summing stage) for simplicity, but in this case each sound beam output from the digital sound projector will have the same window function which may not be optimal.

The two hundred and fifty-six signals at 24-bit and 390 kHz are then each passed through a quantizing/noise shaping circuit also in the FPGA to reduce the data sample word lengths to 8 bits at 390 kHz, whilst maintaining a high signal-to-noise-ratio [SNR] within the audible band (i.e. the signal frequency band from ~20 Hz to ~20 KHz).

A useful implementation practice is to make the SSC be an exact rational number fraction of the DSP master-processing-clock speed, e.g. 100 MHz/256=390,625 Hz which locks sample data rates throughout the system to the processing clocks. It is advantageous to make the digital PWM timing clock frequency also an exact rational number fraction of the DSP master-processing-clock speed. It is specifically advantageous to make the PWM clock frequency an exact integer multiple of the internal digital audio sample data rate, e.g. 512 times the sample rate for 9-bit PWM (because $2^9$=512). The reduction of the digital data word-length to 8, while simultaneously increasing the sample-rate is useful for several reasons:

i) The increased sample-rate allows finer resolution of data-word delays; e.g. at 48 KHz data-rate, the smallest delay increment available is 1 sample period, or ~21 microseconds, whereas at 195 KHz data-rate, the smallest delay increment available is (1 sample period)~5.1 microseconds. It is important to have sound-path-length compensation resolution (=time-delay resolution times speed-of-sound) fine compared to acoustic output-transducer diameter. In 21 microseconds sound in air at NTP travels approximately 7 mm, which is too coarse a resolution when using transducers as small as 10 mm diameter;

ii) It is easier to convert PCM data directly to digital PWM at practical clock-speeds when the word-length is small; e.g. 16-bit words at 48 KHz data-rate require a PWM clock speed of 65536×48 KHz~3.15 GHz (largely impractical), whereas 8-bit words at 195 KHz data-rate require a PWM clock speed of 256×390 KHz~100 MHz (quite practical); and iii) because of the increased sample rate, there is an increased available signal bandwidth at half the sample rate, so e.g. available signal bandwidth ~96 KHz for a sample rate of ~195 KHz; the quantization process (reduction in number of bits) effectively adds quantization noise to the digital data; by spectrally shaping the noise produced by the quantization process, it can be predominantly moved to the frequencies above the baseband signal (i.e. in our case above ~20 KHz), in the region between the top of the baseband (~>20 KHz and <available signal bandwidth~96 KHz); the effect is that nearly all of the original signal information is now carried in a digital data stream with very little loss in SNR.

The data stream with reduced sample word width is distributed in 26 serial data streams at 31.25 Mb/s each and additional volume data. Each data stream is assigned to one of 26 driver boards.

The driver circuit boards, as shown in FIG. 25, which are preferably physically local to the transducers they drive, provide a pulse-width-modulated class-BD output driver circuit for each of the transducers they control. In the present example, each driver boards is connected to ten transducers, whereby the transducers are directly connected to the output of the class-BD output driver circuits without any intervening low-pass-filter [LPF}.

Each PWM generator drives a class-D power switch or output stage which directly drives one transducer, or a series-or-parallel-connected pair of adjacent transducers. The supply voltage to the class-D power switches can be digitally adjusted to control the output power level to the transducers. By controlling this supply voltage over a wide range, e.g. 10:1, the power to the transducer can be controlled over a much wider range, 100:1 for a 10:1 voltage range, or in general $N^2$:1 for an N:1 voltage range. Thus wide-ranging level control (or "volume" control) can be achieved with no reduction in digital word length, so no degradation of the signal due to further quantization (or loss of resolution) occurs. The supply voltage variation is performed by low-loss switching regulators mounted on the same printed circuit boards (PCBs) as the class-D power switches. There is one switching regulator for each class-D switch to minimise power supply line inter-modulation. To reduce cost, each switching regulator can be used to supply pairs, triplets, quads or other integer multiples of class-D power switches. The class-D power switches or output stages, directly drive the acoustic output transducers. In normal class-D power amplifier drives, i.e. the very commonly used so-called "class-AD" amplifiers, it is necessary to place an electronic low-pass-filter [LPF] (invariably, an analogue electronic LPF) between the class-D power stage and the transducer. This is because the common forms of magnetic transducer (and even more so, piezoelectric transducers) present a low load-impedance to the high-frequency PWM carrier frequencies present at high energy in class-AD amplifier outputs. E.g. a class-AD amplifier with zero baseband input signal continues to produce at its output, a full amplitude (usually bipolar) 1:1 mark-space-ratio [MSR] output signal at the PWM switching frequency (in the present case this would be at ~50 or 100 MHz), which if connected across a nominal 8 Ohm load would dissipate full available power in that load, whilst creating no useful acoustic output signal. The commonly used electronic LPF has a cut off frequency above the highest wanted signal output frequency (e.g. >20 KHz) but well below the PWM switching frequency (e.g. ~50 MHz), thus effectively blocking the PWM carrier and minimising the wasted power. Such LPFs have to transmit the full signal power to the electrical loads (e.g. the acoustic transducers) with as low power-loss as possible; usually these LPFs use a minimum of two power-inductors and two, or more usually, three capacitors; the LPFs are bulky and relatively expensive to build. In single-channel (or few-channel) amplifiers, such LPFs can be tolerated on cost grounds, and most importantly, in PWM amplifiers housed separately from their loads (e.g. conventional loudspeakers) which need to be connected by potentially long leads to their loads, such LPFs are in any case necessary for quite different reasons, viz. to prevent the high-frequency PWM carrier getting into the connecting leads where it will most likely cause unwanted stray electromagnetic radiation [EMI] of relatively high amplitude.

In the digital sound projector, the acoustic transducers are connected directly to the physically adjacent PWM power switches by short leads and all are housed within the same enclosure, eliminating the problems of EMI. In the digital sound projector, the PWM generators are of a type known as class-BD; these produce class-BD PWM signals which drive the output power switches and these in turn drive the acoustic output transducers. Class-BD PWM output signals have the property that they return to zero between the full amplitude bipolar pulse outputs, and thus are tristate, not bistate like class-AD signals. Thus, when the digital input signal to a class-BD PWM system is zero, then the class-BD power output state is zero, and not a full-power bipolar 1:1 MSR signal as is produced by class-AD PWM. Thus the class-BD PWM power switch delivers zero power to the load (the acoustic transducer) in this state: no LPF is required as there is no full-power PWM carrier signal to block. Thus in the digital sound projector, by using an array of class-BD PWM amplifiers to drive directly an integral array of transducers, a great saving in cost, and lost power, is achieved, by eliminating the need for an array of power LPFs. Class-BD is rarely used in conventional audio amplifiers, firstly because it is more difficult to make a very high linearity class-BD amplifier, than a similarly linear class-AD amplifier; and secondly because for the reasons stated above an LPF is generally required anyway, for EMI considerations, thus negating the principal benefits of class-BD.

The acoustic output transducers themselves are very effective electroacoustic LPFs and so an absolute minimum of PWM carrier from the class-BD PWM stages is emitted as acoustic energy. Thus in the digital sound projector digital array loudspeaker, the combination of class-BD PWM with direct coupling to in-the-same-box acoustic transducers and without electronic LPFs, is a very effective and cost effective solution to high-efficiency, high-power, multiple transducer driving. Furthermore, since the sound of any one (or more) output channels corresponding to one of the input channels, heard by a listener to the digital sound projector, is a summation of sounds from each and every one of the acoustic output transducers and thus related to a summation of the outputs from each of the power-amplifier stages driving those transducers, non-systematic errors in the outputs of the power switches and transducers will tend to average to zero and be minimally audible. Thus an advantage of the array loudspeaker constructed as described is that it is more forgiving of the quality of individual components, than in a conventional non-array audio system.

In a particular implementation of the digital sound projector with 254 acoustic output transducers arranged in a triangular array of roughly rectangular extent with one axis of the array vertical (and of extent 7 vertical columns of 20 transducers each separated by 6 column of 19 transducers) and with every second output transducer in each vertical column of transducers connected electrically in series or in parallel with the transducer immediately below it, this results in one hundred and thirty two (132) different versions of each of the channels, the number of channels being five in this example, i.e., six hundred and sixty channels in total. A transducer diameter small enough to ensure approximately omnidirectional radiation from the transducer up to high audio frequencies (e.g. >12 KHz to 15 KHz) is important if the digital sound projector is to be able to steer beams of sound at small angles from the plane of the transducer array. Thus a transducer diameter of between 5 mm and 30 mm is optimum for whole audio-band coverage. A transducer-to-transducer spacing small compared with the shortest wavelengths of sound to emitted by the digital sound projector is desirable to minimise the generation of "spurious" sidelobes of acoustic radiation (i.e. beams of acoustic energy produced inadvertently and not emitted in the desired direction(s)). Practical considerations on possible transducer size dictate that transducer spacing in the range 5 mm to 45 mm is best. A triangular array layout is also best for high-areal-packing density of transducers in the array.

As illustrated by FIG. 26, the digital sound projector user-interface produces overlay graphics for on-screen display of setup, status and control information, on any suitably connected video display, e.g. a plasma screen. To this end the video signal from any connected audio-visual source (e.g. a DVD player) may be looped through the digital sound projector en route to the display screen where the digital sound projector status and command information is then also overlayed on the programme video. If the process delay of the signal processing operations from end to end of the digital sound projector are sufficiently long, (e.g. when the length of the compensation filter running on the first two DSPs which depends on the transducer linearity and the equalisation required, is long) then to avoid lip-sync problems, an optional video frame store can be incorporated in the loop-through video path, to re-synchronise the displayed video with the output sound.

The invention claimed is:

1. A method of creating a sound field comprising a plurality of channels of sound using an array of output transducers, said method comprising:

for each channel, selecting a first delay value in respect of each output transducer, said first delay value being chosen in accordance with the position in the array of the respective transducer;

selecting a second delay value for each channel, said second delay value being chosen in accordance with the expected travelling distance of sound waves of that channel from said array to a listener;

obtaining, in respect of each output transducer, a delayed replica of a signal representing each channel, each delayed replica being delayed by a value having a first component comprising said first delay value and a second component comprising said second delay value.

2. A method according to claim 1, wherein said second delay is applied to each signal representing said channel before said signal is replicated; each replica then being delayed by the respective first delay value.

3. A method according to claim 1, wherein said first delay value is also chosen in accordance with a given direction so that each channel of sound is directed in respective direction.

4. A method according to claim 3, wherein each channel is directed in a different respective direction.

5. A method according to claim 1, wherein said second delay value is chosen such that corresponding parts of all sound channels reach the listener at substantially the same time.

6. A method according to claim 1, said plurality of channels comprising at least one surround sound channel and there additionally being a center channel, said array of output transducers being used to direct the at least one surround sound channel in a predetermined direction, said method comprising:

for the at least one surround sound channel, selecting the first delay values in accordance with the position in the array of the respective transducer so as to direct the at least one surround sound channel in said predetermined direction;

for the center channel, selecting a second delay value, said second delay value being chosen in accordance with the expected travelling distance of sound waves of the channels from the array to the listener;

obtaining, in respect of each output transducer, a delayed replica of a signal representing the center channel, each delayed replica being delayed by said second delay value;

outputting said delayed replicas using said array of output transducers.

7. A method according to claim 6, further comprising:

for the center channel, selecting a first delay value in respect of each output transducer, said first delay values being chosen in accordance with the position in the array of the respective transducer so as to direct the center channel in a predetermined direction;

and wherein said step of obtaining, in respect of each output transducer, a delayed replica of a signal representing the center channel further comprises:

delaying each replica of the signal representing said center channel by the first delay value calculated for the respective output transducer and the center channel.

8. A method according to claim 6, wherein replicas of the signal representing said center channel are not delayed by values other than said second delay value, said second delay values being the same for each replica of the signal.

9. A method according to claim 6, wherein said second delay is applied to each signal representing said center channel before said signal is replicated.

10. A method according to claim 6, wherein said sound field comprises two surround sound channels, each surround sound channel being directed in a different direction.

11. A method according to claim 6, wherein said second delay value is chosen such that corresponding parts of all sound channels reach the listener at substantially the same time.

12. A method according to claim 6, wherein said delayed replicas of the signal representing the at least one surround sound channel are added to respective delayed replicas of the signal representing the center channel before being output by the respective output transducers.

13. A method according to claim 6, wherein the sound waves of said at least one surround sound channel are bounced off a surface such as a wall before reaching the listener.

14. A method according to claim 6, wherein said output transducers are directly driven by class-BD PWM amplifiers.

15. Apparatus for creating a sound field comprising:

a plurality of inputs for a plurality of respective signals representing different sound channels;

an array of output transducers;

a replicator arranged to obtain, in respect of each output transducer, a replica of each respective input signal;

a first delay element arranged to delay each replica of each signal by a respective first delay value chosen in accordance with the position in the array of the respective output transducer;

a second delay element arranged to delay each replica of each signal by a second delay value chosen for each channel in accordance with the expected travelling distance of sound waves of that channel from the array to a listener.

16. Apparatus according to claim 15, wherein said second delay element is arranged to delay said input signals before they are replicated by said replicator.

17. Apparatus according to claim 15, wherein said first delay value is also chosen in accordance with a given direction so that each channel of sound is directed in said respective direction.

18. Apparatus according to claim 17, wherein each channel is directed in a different direction.

19. Apparatus according to claim 15, wherein said second delay element is arranged to choose said second delay for each channel such that all sound channels reach a listener at substantially the same time.

20. Apparatus according to claim 15, said plurality of signals comprising a signal representing at least one surround sound channel; said apparatus comprising:

an input signal receiver for receiving said plurality of signals and a signal representing a center channel;

said replicator being arranged to obtain, in respect of each output transducer, a replica of said signal representing said at least one surround sound channel and a replica of said signal representing a center channel;

said first delay element being arranged to delay each replica of said signal representing said at least one surround sound channel by said respective first delay value chosen in accordance with the position in the array of the respective transducer so as to direct the channel in a predetermined direction;

said second delay element being arranged to delay each replica of said signal representing said center channel by a second delay value chosen in accordance with the expected travelling distance of sound waves of the channels from the array to a listener.

21. Apparatus according to claim 20, wherein said first delay element is also arranged to delay each replica of said signal representing said center channel by a respective first delay value chosen in accordance with the position in the array of the respective transducer so as to direct the center channel in a predetermined direction.

22. Apparatus according to claim 20, wherein said second delay element is arranged to delay said input signals before they are replicated by said replicator.

23. Apparatus according to claim 20, wherein said sound field comprises two surround sound channels, and said first delay element is arranged to cause each surround sound channel to be directed in a different direction.

24. Apparatus according to claim 20, wherein said second delay element is arranged to choose said second delay for the channels such that all sound channels reach a listener at substantially the same time.

25. Apparatus according to claim 20, wherein said first delay element and said second delay element are the same physical element.

26. Apparatus according to claim 20, wherein said output transducers are directly driven by class-BD PWM amplifiers.

* * * * *